US011000755B2

(12) United States Patent
Farris et al.

(10) Patent No.: US 11,000,755 B2
(45) Date of Patent: May 11, 2021

(54) IMPACT-ATTENUATION SUB-LAYER FOR A SHOULDER-PAD SYSTEM

(71) Applicant: NIKE, Inc., Beaverton, OR (US)

(72) Inventors: Bryan N. Farris, North Plains, OR (US); David Turner, Portland, OR (US)

(73) Assignee: NIKE, INC., Beaverton, OR (US)

( * ) Notice: Subject to any disclaimer, the term of this patent is extended or adjusted under 35 U.S.C. 154(b) by 203 days.

(21) Appl. No.: 15/481,304

(22) Filed: Apr. 6, 2017

(65) Prior Publication Data

US 2017/0340950 A1 Nov. 30, 2017

Related U.S. Application Data

(60) Provisional application No. 62/319,662, filed on Apr. 7, 2016, provisional application No. 62/319,660, filed (Continued)

(51) Int. Cl.
*A63B 71/12* (2006.01)
*A41D 13/00* (2006.01)

(Continued)

(52) U.S. Cl.
CPC ..... *A63B 71/12* (2013.01); *A41B 1/08* (2013.01); *A41D 13/0015* (2013.01);

(Continued)

(58) Field of Classification Search
CPC ..... A63B 71/12; A63B 71/08; A63B 71/081; A63B 2071/1208; A63B 2102/14;

(Continued)

(56) References Cited

U.S. PATENT DOCUMENTS 1,310,477 A * 7/1919 Hartman ..... A63B 71/12 2/462
2,545,039 A * 3/1951 Mitchel ..... A63B 71/12 2/462

(Continued)

FOREIGN PATENT DOCUMENTS

CA 2622264 A1 8/2008
CA 2841674 A1 7/2015

(Continued)

OTHER PUBLICATIONS

"Neoprene shoulder support brace compression effective shoulder guard," Alibaba®, wholesaler.alibaba.com, accessed: Dec. 2015. http://wholesaler.alibaba.com/product-detail/Neoprene-shoulder-support-bracebelt-unisex_6034047466.html?spm=a2700.7724857.29.82.JdFwmm.

(Continued)

*Primary Examiner* — Khaled Annis
*Assistant Examiner* — Dakota Marin
(74) *Attorney, Agent, or Firm* — Shook, Hardy & Bacon L.L.P.

(57) ABSTRACT

Aspects herein relate to a shoulder-pad system that may be used to attenuate impact in various contexts. The shoulder-pad system may have a number of subcomponents, which may include an impact-plate assembly, an impact-attenuation sub-layer, a base-layer garment, and a securing garment, among others. The shoulder-pad system may be described as modular, in that the various subcomponents may be added to, and/or removed from the system when it is desirable to do so.

13 Claims, 20 Drawing Sheets

Related U.S. Application Data on Apr. 7, 2016, provisional application No. 62/319,664, filed on Apr. 7, 2016.

(51) Int. Cl.

| | |
|---|---|
| ***A41D 13/05*** | (2006.01) |
| ***A41B 1/08*** | (2006.01) |
| *A63B 102/24* | (2015.01) |
| *A63B 102/14* | (2015.01) |
| *A63B 102/22* | (2015.01) |
| *A63B 71/08* | (2006.01) |
| *A63B 102/18* | (2015.01) |

(52) U.S. Cl.

CPC ..... *A41D 13/0512* (2013.01); *A41D 13/0518* (2013.01); *A41D 2600/10* (2013.01); *A63B 71/08* (2013.01); *A63B 71/081* (2013.01); *A63B 2071/1208* (2013.01); *A63B 2102/14* (2015.10); *A63B 2102/18* (2015.10); *A63B 2102/22* (2015.10); *A63B 2102/24* (2015.10); *A63B 2225/50* (2013.01); *A63B 2230/00* (2013.01); *A63B 2230/06* (2013.01); *A63B 2230/50* (2013.01); *A63B 2243/007* (2013.01)

(58) Field of Classification Search

CPC ..... A63B 2102/18; A63B 2012/22; A63B 2102/24; A63B 2225/50; A63B 2230/00; A63B 2230/06; A63B 2230/50; A63B 2243/007; A41B 1/08; A41D 13/0015; A41D 13/0512; A41D 13/0518; A41D 2600/10

USPC ..... 2/459, 461, 462, 44, 45

See application file for complete search history.

(56) References Cited

U.S. PATENT DOCUMENTS 2,902,695 A 9/1959 Werner
3,064,265 A 11/1962 Bridgewaters et al.
3,452,362 A 7/1969 Korolick et al.
3,561,009 A 2/1971 Huggins
3,740,763 A 6/1973 Mitchell
3,866,241 A 2/1975 Grant
3,867,726 A 2/1975 Owl et al.
3,981,027 A 9/1976 Anderson
4,320,537 A * 3/1982 Mitchell ..... A63B 71/12 2/462
4,467,475 A 8/1984 Gregory et al.
4,554,681 A * 11/1985 Kirkland ..... A63B 71/12 2/462
4,590,622 A 5/1986 Wolfe et al.
4,698,849 A 10/1987 Mitchell et al.
4,868,925 A 9/1989 Mitchell
4,987,610 A 1/1991 Hunt
5,020,156 A * 6/1991 Neuhalfen ..... A41D 13/0518 2/2.5
5,054,121 A * 10/1991 Mitchell ..... A63B 71/12 2/22
5,065,457 A 11/1991 Henson
5,173,964 A 12/1992 Ball
5,187,812 A 2/1993 Neuhalfen
5,245,706 A 9/1993 Moschetti
5,319,806 A 6/1994 Hermann
5,349,704 A 9/1994 Masters
5,390,368 A * 2/1995 Chang ..... A63B 71/12 2/45
5,403,268 A 4/1995 Clement
5,530,966 A 7/1996 West
5,623,728 A * 4/1997 Wagner ..... A63B 71/12 2/16
5,742,939 A 4/1998 Williams
5,754,982 A 5/1998 Gainer
5,863,236 A 1/1999 Johnson
6,021,528 A 2/2000 Jurga et al.
6,060,408 A 5/2000 Monica
6,079,056 A 6/2000 Fogelberg
6,088,831 A 7/2000 Jensen et al.
6,202,214 B1 3/2001 Light
6,247,188 B1 6/2001 Béland
6,260,196 B1 7/2001 van der Sleesen
6,389,600 B1 5/2002 Di Maio
6,484,325 B1 11/2002 Lazarus et al.
6,510,559 B1 1/2003 Linares
6,519,775 B1 2/2003 Garcia
6,553,579 B1 4/2003 Gillen et al.
6,709,411 B1 3/2004 Olinger
6,845,522 B2 1/2005 Beland
6,880,347 B1 4/2005 Stam
7,003,803 B1 2/2006 Lyden
7,854,026 B2 12/2010 Phaneuf et al.
7,871,388 B2 * 1/2011 Brown ..... A61F 5/026 602/19
7,882,576 B2 2/2011 Morrow et al.
8,015,621 B2 9/2011 Udelhofen
8,082,602 B2 12/2011 Crelinsten et al.
8,221,291 B1 * 7/2012 Kantarevic ..... G06F 19/3481 482/8
8,336,124 B2 12/2012 Crelinsten et al.
8,533,871 B2 9/2013 Fiegener et al.
8,818,478 B2 * 8/2014 Scheffler ..... A41D 1/002 600/388
8,850,613 B2 10/2014 Kordecki
8,869,315 B2 10/2014 Contant et al.
8,869,316 B2 10/2014 Lewis
2004/0003448 A1 * 1/2004 Morrow ..... A63B 71/12 2/92
2004/0210992 A1 10/2004 Morrow et al.
2005/0102741 A1 * 5/2005 McQueer ..... A41D 13/0015 2/459
2006/0048292 A1 3/2006 Gillen et al.
2006/0053535 A1 * 3/2006 Ide ..... A63B 71/12 2/459
2007/0050886 A1 * 3/2007 Brassill ..... A41D 13/0153 2/115
2007/0151004 A1 * 7/2007 Brassill ..... A63B 71/12 2/461
2007/0199129 A1 8/2007 Davis
2008/0313793 A1 * 12/2008 Skottheim ..... A41D 13/0153 2/461
2009/0235440 A1 * 9/2009 Udelhofen ..... A63B 71/12 2/462
2009/0271916 A1 * 11/2009 Harris ..... A63B 71/12 2/456
2009/0282609 A1 * 11/2009 Kotoske ..... A41D 13/0562 2/463
2010/0011482 A1 1/2010 Chang
2010/0088808 A1 * 4/2010 Rietdyk ..... A41D 13/0531 2/467
2010/0192287 A1 8/2010 Kraemer et al.
2010/0210985 A1 8/2010 Kuorak et al.
2010/0242158 A1 9/2010 Blakely et al.
2011/0239355 A1 10/2011 Lee
2011/0247130 A1 * 10/2011 Lewandowski .... A41D 13/0153 2/459
2011/0277212 A1 11/2011 Jones
2011/0277226 A1 11/2011 Turner
2012/0198606 A1 8/2012 Bowden et al.
2012/0255094 A1 10/2012 Dragony
2012/0311774 A1 * 12/2012 Chen ..... A41D 13/0518 2/463
2013/0014318 A1 1/2013 Jourde et al.
2013/0036537 A1 2/2013 Reynolds et al.
2013/0232653 A1 9/2013 Conca
2013/0274587 A1 * 10/2013 Coza ..... A61B 5/6804 600/409
2014/0201883 A1 7/2014 Achtymichuk
2015/0000003 A1 1/2015 Blakely et al.
2015/0033451 A1 2/2015 Bradshaw
2015/0101110 A1 4/2015 Wagner et al.

(56) References Cited

U.S. PATENT DOCUMENTS

| | | | | |
|---|---|---|---|---|
| 2015/0157484 | A1* | 6/2015 | Ex-Lubeskie | A61F 5/013 602/19 |
| 2015/0157917 | A1 | 6/2015 | Gennario, Jr. | |
| 2015/0181950 | A1 | 7/2015 | Skottheim et al. | |
| 2015/0216240 | A1 | 8/2015 | Martel | |
| 2015/0237924 | A1 | 8/2015 | Cosio | |
| 2015/0264987 | A1 | 9/2015 | Morin et al. | |
| 2017/0291098 | A1 | 10/2017 | Farris et al. | |

FOREIGN PATENT DOCUMENTS

| | | | |
|---|---|---|---|
| CN | 2172964 | Y | 8/1994 |
| CN | 2243792 | Y | 1/1997 |
| CN | 201097635 | Y | 8/2008 |
| CN | 201111354 | Y | 9/2008 |
| CN | 102987590 | A | 3/2013 |
| CN | 104955347 | A | 9/2015 |
| DE | 20215653 | U1 | 1/2003 |
| EP | 1080647 | A2 | 3/2001 |
| JP | 3175831 | U | 5/2012 |
| WO | 2015153343 | A1 | 10/2015 |

OTHER PUBLICATIONS

"Featured Lacross Items: Hot Seller—STX Impact Shoulder Pads," Play It Again Sports®, playitagainsportsstmatthews.com, accessed: Dec. 2015. http://www.playitagainsportsstmatthews.com/equipment/category/7466.

"Mcdavid Light Shoulder Support," Amazon, amazon.com, ASIN: B002DPBH4S, accessed: Dec. 2015. http://www.amazon.com/McDavid-463R-Mcdavid-Shoulder-Support/dp/B002DPBH4S/ref=pd_sim_200_3?ie=UTF8&,dpID=41o35rXbwwL&dpSrc=sims&preST=_AC_UL160_SR160%2C160_&refRID=0R4DNBSTXY2G7QNCKPZZ.

International Search Report and Written Opinion dated Sep. 14, 2017 in International Patent Application No. PCT/US2017/026601, 22 pages.

International Search Report and Written Opinion dated Jul. 11, 2017 in International Patent Application No. PCT/US2017/026614, 16 pages.

International Search Report and Written Opinion dated Jul. 11, 2017 in International Patent Application No. PCT/US2017/026589, 17 pages.

International Preliminary Report on Patentability dated Oct. 18, 2018 in International Patent Application No. PCT/US2017/026589, 10 pages.

International Preliminary Report on Patentability dated Oct. 18, 2018 in International Patent Application No. PCT/US2017/026601, 12 pages.

International Preliminary Report on Patentability dated Oct. 18, 2018 in International Patent Application No. PCT/US2017/026614, 9 pages.

Non-Final Office Action dated Sep. 5, 2019 in U.S. Appl. No. 15/481,146, 16 pages.

Non-Final Office Action dated Oct. 31, 2019 in U.S. Appl. No. 15/480,761, 25 pages.

Notice of Allowance received for U.S. Appl. No. 15/481,146, dated Feb. 25, 2020, 7 pages.

Intention to Grant received for European Patent Application No. 17719975.9, dated Jan. 16, 2020, 6 pages.

Intention to Grant received for European Patent Application No. 17721232.1, dated Jan. 17, 2020, 6 pages.

Final Office Action received for U.S. Appl. No. 15/480,761, dated May 13, 2020, 31 pages.

Extended European Search Report received for European Patent Application No. 201761053, dated Aug. 28, 2020, 9 pages.

Non-Final Office Action received for U.S. Appl. No. 15/480,761, dated Oct. 5, 2020, 21 pages.

Notice of Allowance received for U.S. Appl. No. 15/480,761, dated Feb. 22, 2021, 11 pages.

Office Action received for European Patent Application No. 17719424.8, dated Feb. 26, 2021, 5 pages.

* cited by examiner

IMPACT-ATTENUATION SUB-LAYER FOR A SHOULDER-PAD SYSTEM

CROSS-REFERENCE TO RELATED APPLICATIONS

This application claims priority to U.S. Provisional Application No. 62/319,662, filed Apr. 7, 2016, titled "Impact-Attenuation Sub-Layer for a Shoulder-Pad System," and further claims priority to U.S. Provisional Application No. 62/319,660, filed Apr. 7, 2016, titled "Securing Garment for a Shoulder-Pad System," and further claims priority to U.S. Provisional Application No. 62/319,664, filed Apr. 7, 2016, titled "Discrete Shoulder Sleeve for a Shoulder-Pad System." The entireties of the aforementioned applications are incorporated by reference herein.

TECHNICAL FIELD

This disclosure describes a shoulder-pad system and subcomponents thereof, including an impact-attenuation sub-layer.

BACKGROUND

Shoulder pads are utilized in various contexts to provide protection from impact to a wearer. For example, shoulder pads are often worn in American style football, hockey, lacrosse, and motocross, among other activities. Some styles of shoulder pads include various drawbacks, such as restricted range-of-motion, which may limit the ability of a wearer to fully extend or rotate his or her arms upward. In addition, some styles of shoulder pads may be too bulky or may necessitate constant readjustment after being impacted. These are only some of the exemplary issues presented by some typical shoulder pads.

BRIEF DESCRIPTION OF THE DRAWINGS

The present invention is described in detail herein with reference to the attached drawing figures, which are incorporated herein by reference, wherein.

DETAILED DESCRIPTION

Figure 1:
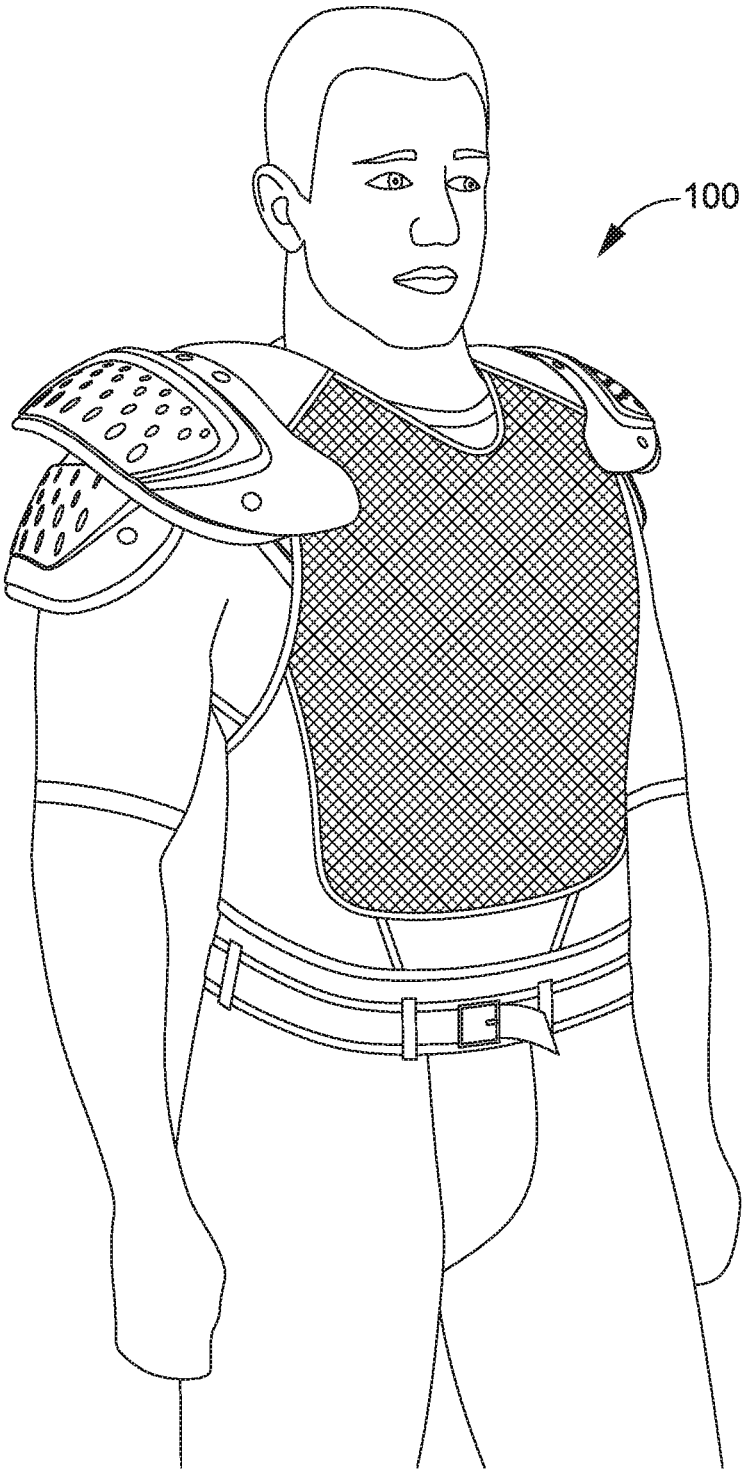
FIG. 1 depicts an exemplary shoulder-pad system in an as-worn orientation, in accordance with an aspect hereof.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are similar to the ones described in this disclosure and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by and is within the scope of the claims.

Generally, aspects of this disclosure describe a shoulder-pad system having various subcomponents, such as a base layer garment, an impact-attenuation sub-layer, and an impact-plate assembly. In addition, the system may include one or more garments that are wearable to secure the base layer garment, the impact-attenuation sub-layer, the impact-plate assembly, and any combination thereof. The impact-attenuation sub-layer is wearable over the base layer and may be combined with the base layer to provide a first amount of impact attenuation (e.g., during light-contact practice). Additionally, the base layer and the impact-attenuation sub-layer may be layered beneath an impact-plate assembly to provide another amount of impact attenuation (e.g., during full-contact engagement and/or competition).

Among other features, the impact-attenuation sub-layer includes discrete lateral elements. For example, the impact-attenuation sub-layer includes a left lateral component and a right-lateral component that are not connected directly to one another. Further, the discrete lateral elements are not directly coupled with an impact-plate system layered directly atop the discrete lateral elements. As such, the discrete lateral elements are movable independent from one another and from the impact-plate assembly, such as when the athlete moves or when the system absorbs an impact.

In one aspect, the disclosure includes an impact-attenuation sub-layer for a shoulder-pad system, the impact-attenuation sub-layer including a first impact-attenuation component and a second impact-attenuation component. (The first and second impact-attenuation components may be described as mirror-images of one another, such that a description of one of the components may equally apply to the other component. For ease of readability, in some instances only one of the components may be described.) The first and second impact-attenuation components each include a cushioning component, which has a first surface and a second surface opposing, and facing away from, the first surface. The cushioning component includes a thickness between the first surface and the second surface, the second surface having a releasable fastener. In addition, the cushioning component also includes a perimeter edge forming a boundary around the cushioning component, the perimeter edge of the cushioning component of the first impact-attenuation component being discontinuous with the perimeter edge of the cushioning component of the second impact-attenuation component. The first and second impact-attenuation components also each include a shoulder-cap component coupled to the cushioning component and extending outward, and away from, the perimeter edge. The shoulder-cap component has a third surface facing in a same direction as the first surface and an impact plate that comprises at least part of the third surface.

In another aspect, the disclosure describes a garment including a shirt body. The shirt body has an anterior portion (e.g., front), a posterior portion (e.g., back), a first shoulder yoke, and a second shoulder yoke. The anterior portion, the posterior portion, the first shoulder yoke, and the second shoulder yoke are constructed of one or more textile layers, and the first and second shoulder yokes connect the anterior portion to the posterior portion and form a neck-receiving opening. The garment also includes a first anterior releasable fastener coupled to the anterior portion on a first lateral side of the shirt body, a second anterior releasable fastener coupled to the anterior portion on a second lateral side of the shirt body, a first posterior releasable fastener coupled to the posterior portion on the first lateral side of the shirt body, and a second posterior releasable fastener coupled to the posterior portion on the second lateral side of the shirt body. A first impact-attenuation component having a first cushioning component is connectable to the shirt body. The first cushioning component includes a first-cushion anterior portion, a first-cushion posterior portion, and a first-cushion shoulder yoke connecting the first-cushion anterior portion to the first-cushion posterior portion. The first-cushion anterior portion includes a first-cushion anterior releasable fastener that releasably mates with the first anterior releasable fastener, and the first-cushion posterior portion includes a first-cushion posterior releasable fastener that releasably mates with the first posterior releasable fastener. The first-cushion shoulder yoke at least partially covers the first shoulder yoke of the shirt body when the first-cushion anterior releasable fastener mates with the first anterior releasable fastener and the first-cushion posterior releasable fastener mates with the first posterior releasable fastener. The garment also includes a second impact-attenuation component having a second cushioning component, and the second impact-attenuation component is also connectable to the shirt body in a manner similar to the first impact-attenuation component. The second cushioning component includes a second-cushion anterior portion, a second-cushion posterior portion, and a second-cushion shoulder yoke connecting the second-cushion anterior portion to the second-cushion posterior portion. The second-cushion anterior portion includes a second-cushion anterior releasable fastener that releasably mates with the second anterior releasable fastener, and the second-cushion posterior portion includes a second-cushion posterior releasable fastener that releasably mates with the second posterior releasable fastener. The second-cushion shoulder yoke at least partially covers the second shoulder yoke of the shirt body when the second-cushion anterior releasable fastener mates with the second anterior releasable fastener and the second-cushion posterior releasable fastener mates with the second posterior releasable fastener.

A further aspect of the disclosure is related to a shoulder-pad system having an impact-attenuation sub-layer positionable underneath an impact-plate assembly, the impact-attenuation sub-layer and the impact-plate assembly making up at least part of the shoulder-pad system. The shoulder-pad system includes a first lateral side and a second lateral side, the first and second lateral sides being substantially mirror-image constructions of one another. The first and second lateral sides each include the impact-attenuation sub-layer comprising a cushioning component and a shoulder-cap component. The cushioning component includes a first surface, a second surface, and a thickness between the first surface and the second surface, the first surface facing towards the impact-plate assembly when the impact-attenuation sub-layer is positioned underneath the impact-plate assembly. The cushioning component also includes an anterior cushion portion, a posterior cushion portion, and a shoulder yoke, the shoulder yoke connecting the anterior cushion portion to the posterior cushion portion. The shoulder-cap component is hingedly coupled to the shoulder yoke. The impact-plate assembly also includes an anterior plate assembly, a posterior plate assembly, and a shoulder assembly, the shoulder assembly including an arched frame connecting the anterior plate assembly to the posterior plate assembly. The arched frame includes a convex, crown-side surface, and a concave surface opposing the convex, crown-side surface. The shoulder yoke of the cushioning component is nested within the arched frame, and the first surface of the cushioning component is layered against the concave surface of the arched frame. The first surface of the cushioning component may not include any fasteners for coupling the impact-attenuation sub-layer directly to the impact-plate assembly.

Having generally described various aspects of the disclosure, reference will now be made to the various figures.

Aspects of an Exemplary Shoulder-Pad System

As previously indicated, this disclosure generally describes a shoulder-pad system that may be used to attenuate impact in various contexts, such as in American-style football, lacrosse, hockey, motocross, and the like, and an exemplary shoulder-pad system 100 is illustrated in FIG. 1 in an as-worn configuration. The shoulder-pad system 100 is depicted in FIG. 1 in a partially assembled arrangement, and as will be described in subsequent portions of this disclosure, the shoulder-pad system 100 includes a number of subcomponents that are combinable in different arrangements to construct various portions of the shoulder-pad system 100. The shoulder-pad system 100 includes certain features and functionality that arise from the shoulder-pad system 100 as a whole. In addition, the subcomponents each include certain features and functionality that arise from the sub-component independently, as well as the synergistic interaction of the sub-component with one or more other subcomponents.

Figure 2:
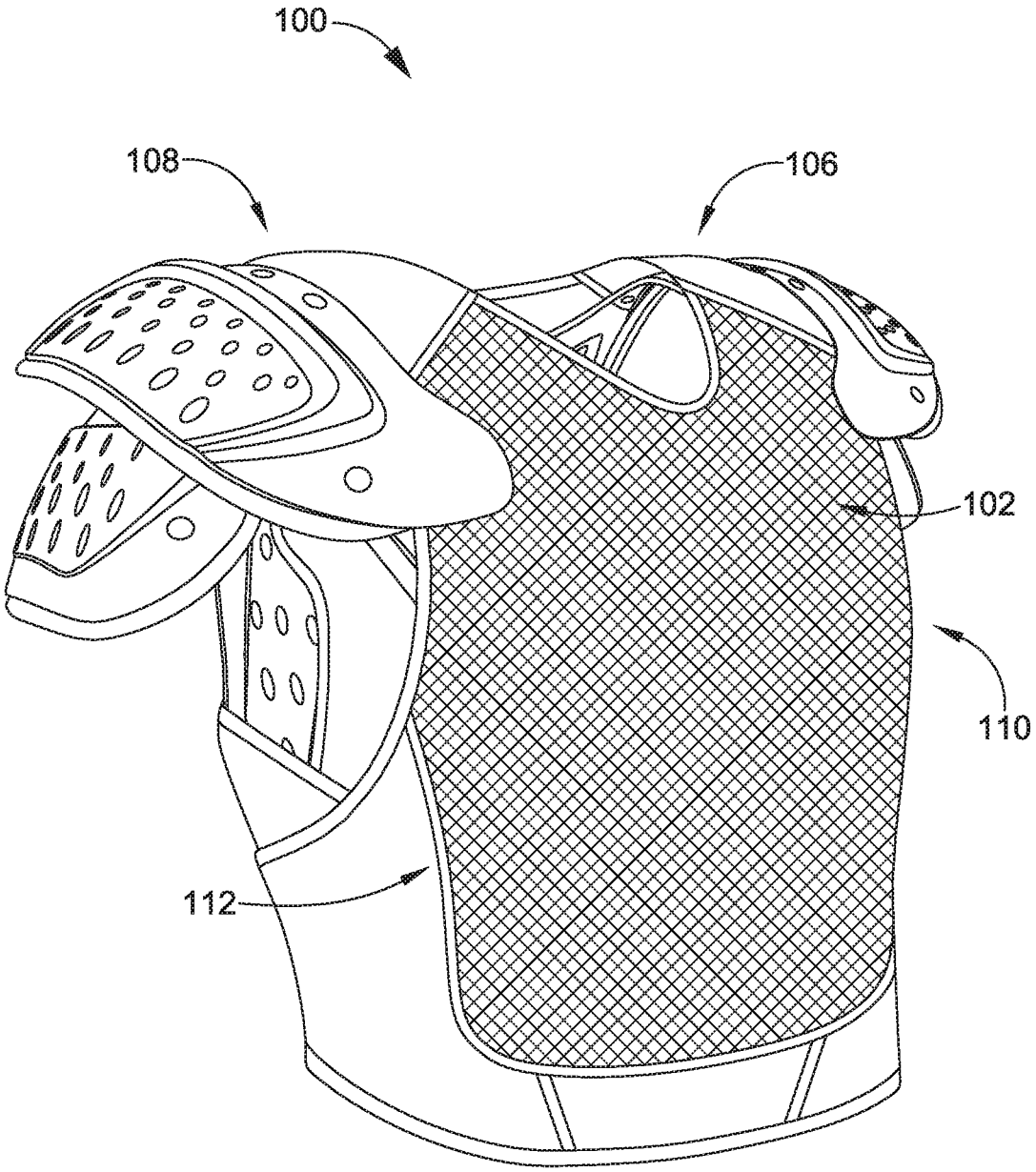
FIG. 2 depicts a front-perspective view of the shoulder-pad system, in accordance with an aspect hereof.
Figure 3:
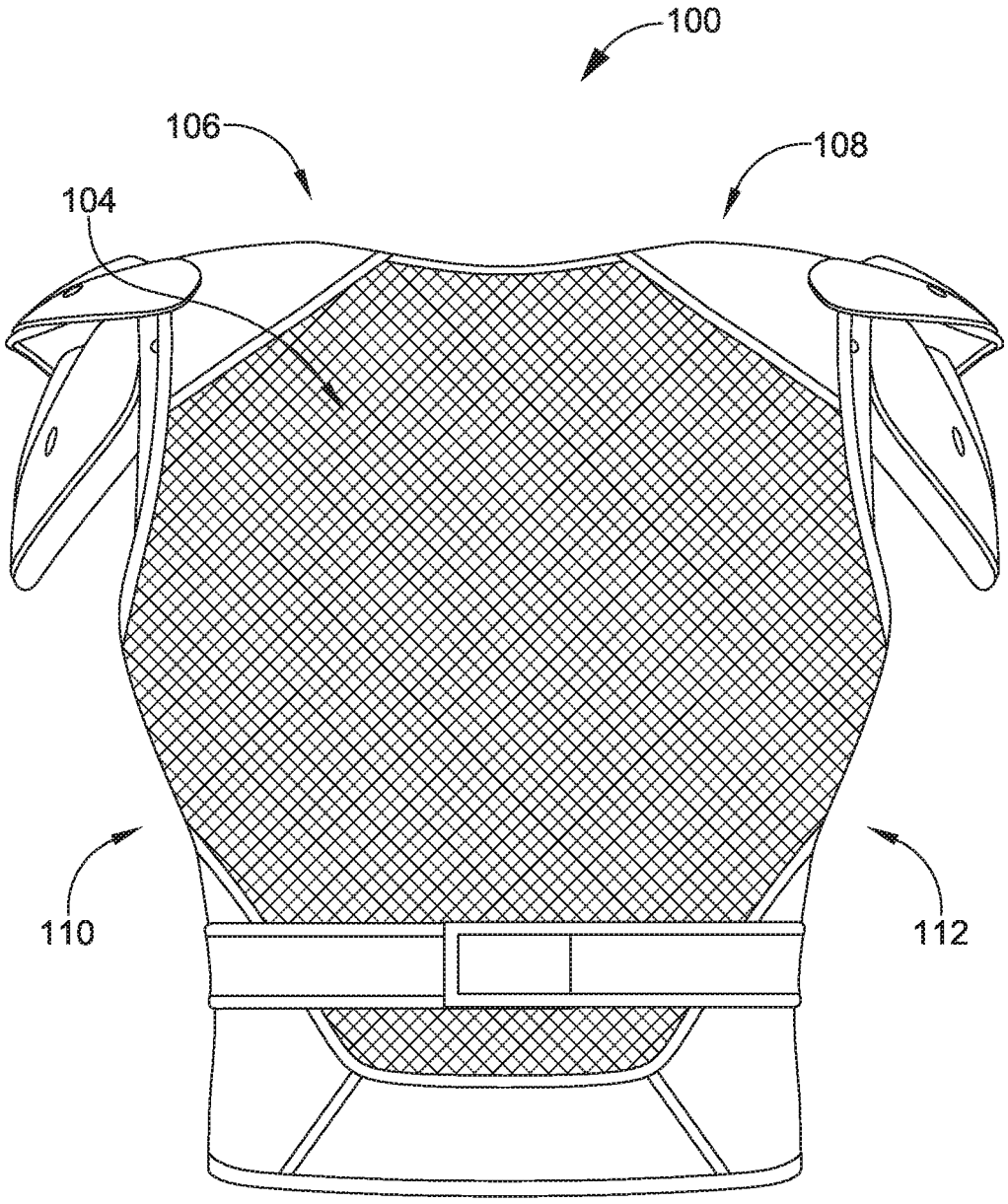
FIG. 3 depicts a back view of the shoulder-pad system, in accordance with an aspect hereof.

Referring now to FIGS. 2 and 3, the shoulder-pad system 100 generally includes a yoke-like arrangement with a front and a back coupled by shoulder portions. The front, the back, and the shoulder portions define a neck-receiving opening, and in order to don or wear the shoulder-pad system 100, a person's head and neck are passed through the neck-receiving opening, such that the shoulder portions are supported on his or her shoulders. The shoulder-pad system 100 generally functions to attenuate impacts or forces to which shoulder-pad system 100 may be subjected.

When describing various aspects of the shoulder-pad system 100, relative terms may be used to aid in understanding relative relationships. For instance, the shoulder-pad system 100 may be divided into an anterior region 102 that generally corresponds with a chest and/or abdomen of a wearer, and a posterior region 104 that generally correspond with a back of a wearer, such as a cervical region, thoracic region, lumbar region, and or scapula region. Both the anterior region 102 and the posterior region 104 may include medial portions and lateral portions, the medial portions being positioned relatively more towards a vertical mid-line (based on the orientation of the system as depicted in FIG. 1) than the lateral portions. The lateral portions may include a left-lateral portion 110 and a right-lateral portion 112. In addition, both the anterior region 102 and the posterior region 104 may include inferior portions and superior portions, the inferior portions being oriented lower than the superior portions, based on the orientation of the system as depicted in FIG. 1. Furthermore, the shoulder-pad system 100 may include shoulder regions that bridge the anterior portion(s) 102 to the posterior portion(s) 104 and that generally correspond with the shoulder of a wearer. The shoulder regions include a left-shoulder region 106 that corresponds with a left laterality and a right-shoulder region 108 that corresponds with a right laterality.

The relative areas 102, 104, 106, 108, 110, and 112 are not intended to demarcate precise areas of the shoulder-pad system 100. Rather, the relative areas 102, 104, 106, 108, 110, and 112 are intended to represent general areas of the shoulder-pad system 100 to aid in understanding the various descriptions provided in this disclosure. In addition, it is understood that a portion of the shoulder-pad system 100 may include multiple regions or areas. For example, the anterior region 102 may extend through both the right-lateral side 112, the medial area, and the left-lateral side 110. And the left-lateral side 110 may include portions of both the anterior region 102 and the posterior region 104. The relative areas 102, 104, 106, 108, 110, and 112 are provided for explanatory and illustrative purposes and are not meant to depend on a human being for interpretive purposes. Accordingly, some aspects herein may be described as corresponding to a left front quadrant, a right front quadrant, a left rear quadrant, and/or a right rear quadrant.

Figure 4:
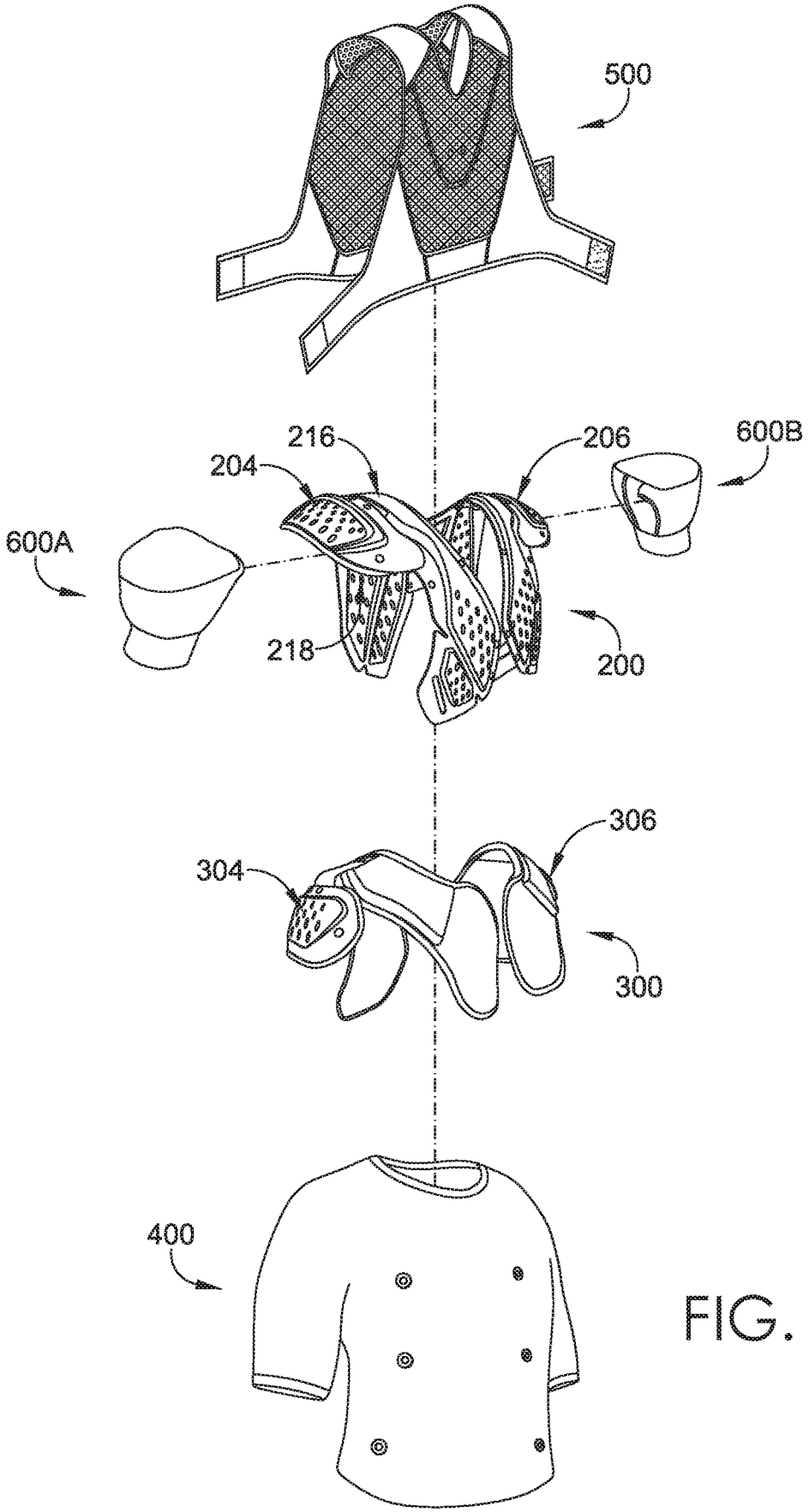
FIG. 4 depicts an exploded view of the shoulder-pad system, in accordance with an aspect hereof.

Referring now to FIG. 4, the shoulder-pad system 100 is illustrated in an exploded view, which depicts various possible subcomponents of the shoulder-pad system 100. For example, the shoulder-pad system 100 includes an impact-plate assembly 200, an impact-attenuation sub-layer 300, and a base-layer garment 400. The base-layer garment 400 includes a variety of garments that may be worn directly under the impact-attenuation sub-layer, such as a sleeved shirt or sleeveless shirt. The impact-attenuation sub-layer is generally a cushion layer that is removeably coupled to the garment 400 and that helps to absorb and/or attenuate at least some of the impact force from the impact-plate assembly 200. The impact-plate assembly 200 is generally more rigid (as compared with the garment 400 and the impact-attenuation sub-layer 300) and includes a set of impact plates that are coupled together (e.g., chest plate, upper back plate, epaulette, etc.). The plates of the impact-plate assembly 200 may be constructed of various materials having a higher rigidity, such as a polypropylene material, a styrene-butadiene copolymer material, carbon-fiber based material, and the like. Generally, the impact-attenuation sub-layer 300 is layered over the base-layer garment 400, and the impact-plate assembly 200 is layered over the impact-attenuation sub-layer 300.

In addition, the shoulder-pad system 100 includes various garments that fit onto, and at least partially around, different portions of the shoulder-pad system 100 in order to at least partially secure the portions of the shoulder-pad system together. In this sense, the garments may at least partially encase, wrap, or enclose portions of the shoulder-pad system. In addition, the garments may function to secure portions of the shoulder-pad system 100 to an athlete. For example, the shoulder-pad system 100 includes a securing garment 500 that is positionable over the impact-plate assembly 200 and that may be securable to the impact-plate assembly 200 and to one or more other garments (e.g., pants, belt, base layer(s), etc.). Furthermore, the shoulder-pad system 100 includes a pair of discrete shoulder sleeves 600A and 600B that are detached from other garment portions, such as the securing garment 500, base-layer garment 400, or other upper-body garments (e.g., uniform jersey), and that are attachable to other portions other portions of the system (e.g., to an epaulette plate). The various subcomponents depicted in FIG. 4 are exemplary of one aspect of the disclosure, and these subcomponents might be modified in various manners to include additional, fewer, or different features.

Figure 18:
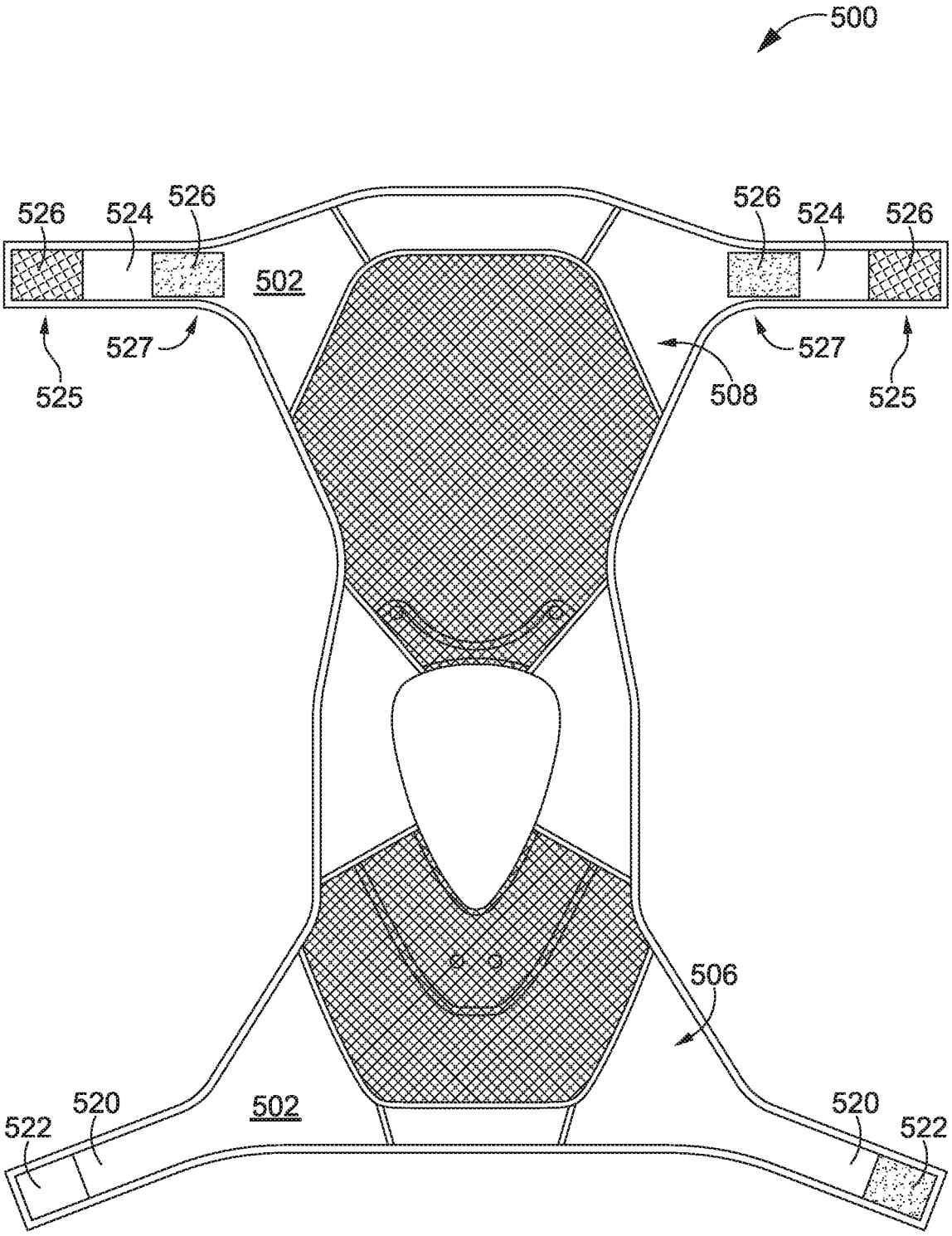
FIG. 18 depicts a plan view of an outward-facing side of an upper-body garment in accordance with an aspect hereof.
Figure 19:
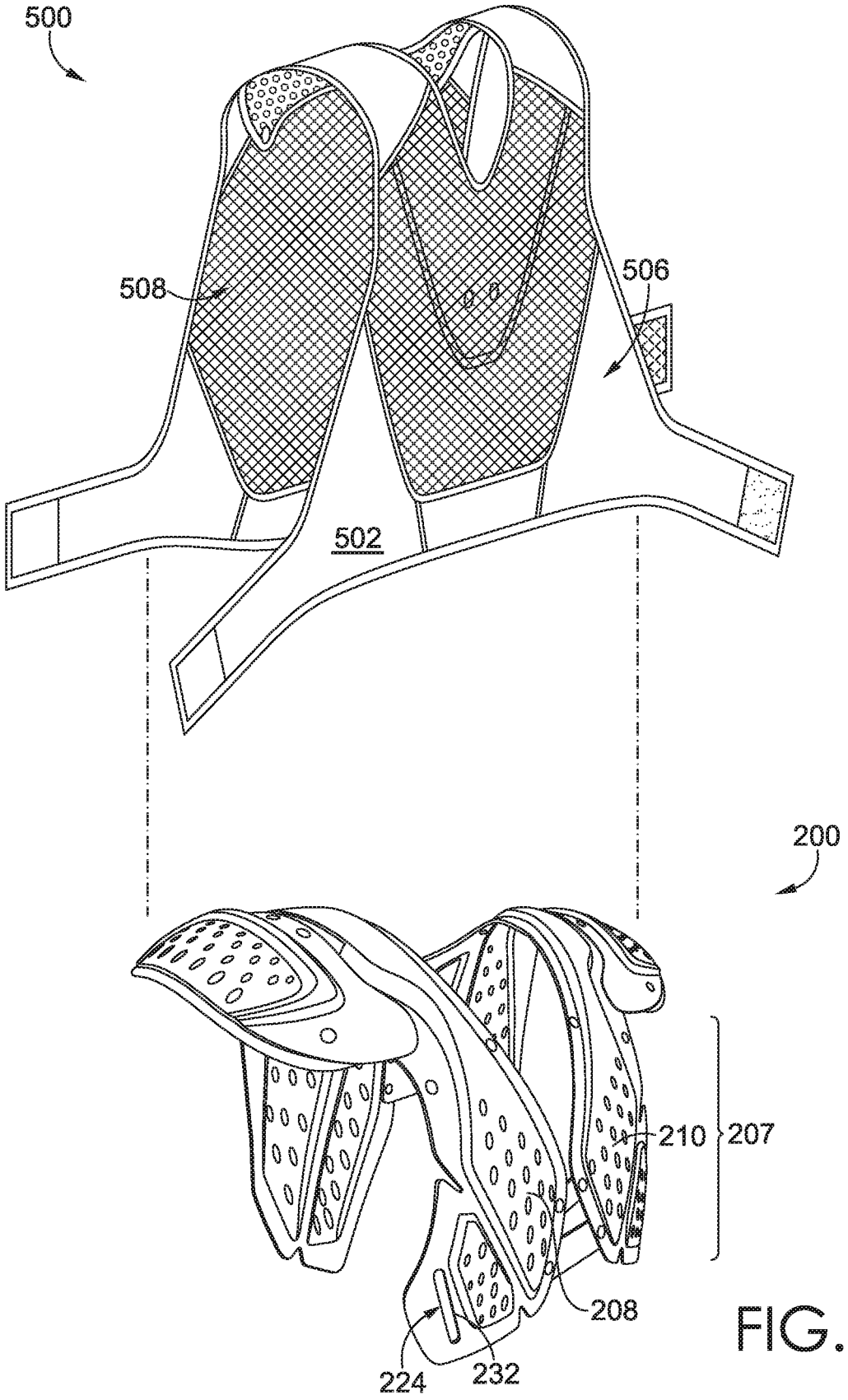
FIG. 19 depicts an exploded view of at least part of a shoulder-pad assembly in accordance with an aspect hereof.
Figure 20:
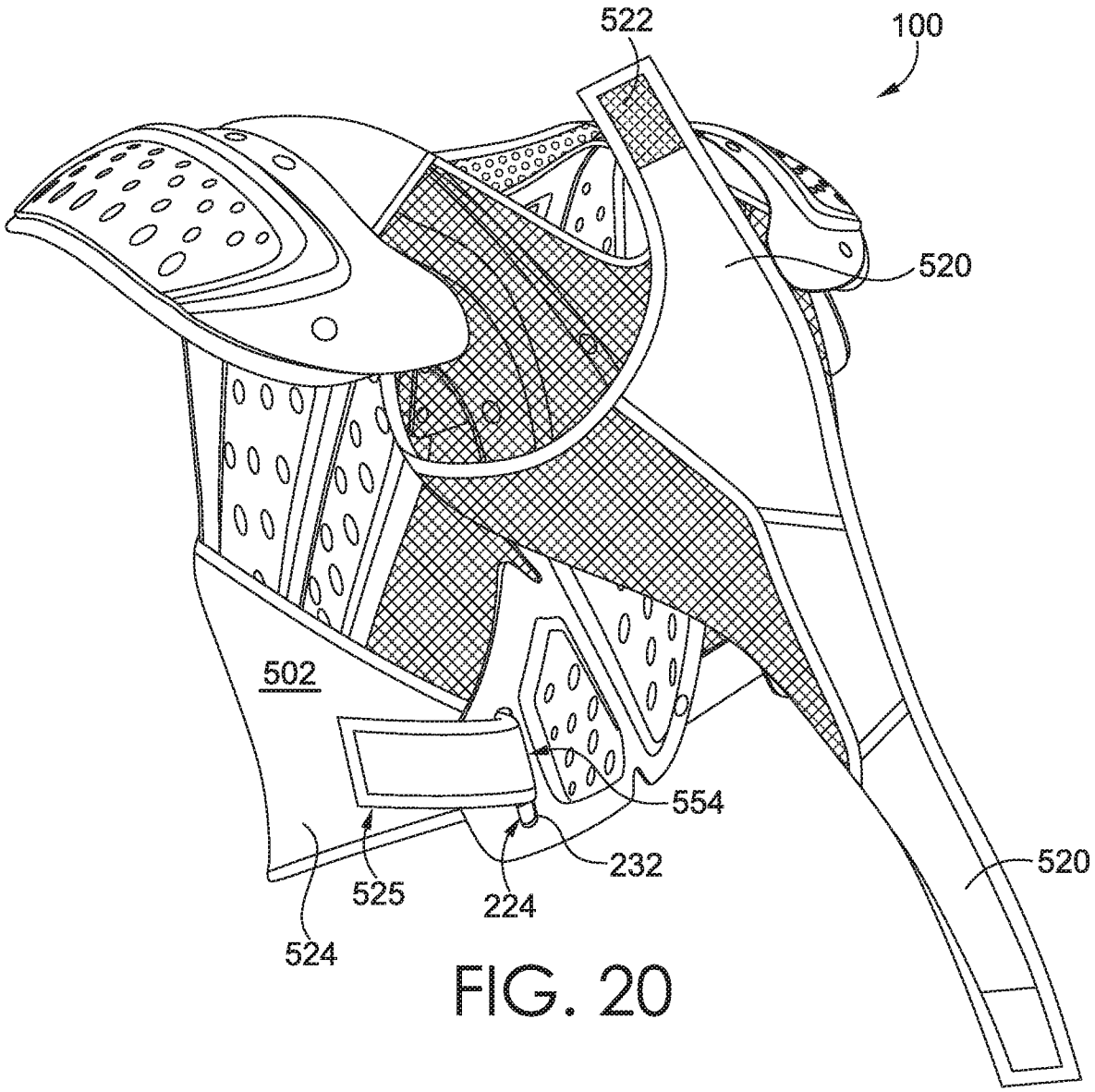
FIG. 20 depicts a perspective view of a partially assembled shoulder-pad assembly in accordance with an aspect hereof.

Turning briefly to FIGS. 18-20, the securing garment 500 may further include one or more first lateral panels 520 affixed to the anterior panel 506, the posterior panel 508, or a combination thereof. The exemplary securing garment 500 includes two first lateral panels 520 affixed to and extending from the anterior panel 506. The one or more first lateral panels 520 may include a first releasable fastener 522, such as a hook-and-loop fastener, a buckle, a clip, a male-and-female fastener (e.g., stud and socket, snap, etc.), button, and the like. For example, the first releasable fastener 522 is depicted as a hook and loop fastener. In some aspects, the one or more first lateral panels 520 may extend around the securing garment 500 when the securing garment 500 is in the as-worn position and couple to one another or couple to the outward-facing surface 502 of the posterior panel 508. In other aspects, the one or more first lateral panels 520 may be integrally formed in the anterior panel 506 or posterior panel 508.

In some aspects, the securing garment 500 may include one or more second lateral panels 524 affixed to the anterior panel 506, posterior panel 508, or a combination thereof. The exemplary securing garment 500 in FIGS. 10-20 includes two second lateral panels 524 affixed to and extending from the posterior panel 508. The one or more second lateral panels 524 may include one or more additional releasable fasteners 526, which may include any of a variety of fasteners, such as a hook-an-loop fastener, a male-and-female fastener, button, and the like. FIG. 18 depicts one exemplary aspect in which each of the second lateral panels 524 includes a distal portion 525 having a first part of the releasable fastener on the outward-facing surface and a proximal portion 527 having a second part of the releasable fastener that mates with the first part. In FIG. 18, the releasable fasteners 526 include hook-and-loop strips. In an aspect of the present invention, the distal portions 525 of the second lateral panels 524 are configured to wrap around an anchoring point on the impact-plate assembly 200 and releasably attach to the proximal portions (see e.g., FIG. 20).

Although the one or more first lateral panels 520 and the one or more second lateral panels 524 have each been described as configured to wrap in a certain arrangement around the securing garment 500 and/or around the impact-plate assembly 200, it is understood that the described positioning and coupling is not the only suitable way for providing same. For example, the anterior and posterior panels on a same lateral side of the garment may releasably connect to one another. For example, the right-side anterior panel may releasably connect to the right-side posterior panel, using any of a variety of releasable fasteners, such a hook-and-loop fastener, a buckle, a clip, a male-and-female fastener (e.g., stud and socket, snap, etc.), button, and the like.

The subcomponents in FIG. 4 might be worn or utilized in various contexts and manners. For instance, the base-layer garment 400 might be positioned onto an athlete initially. The base-layer garment 400 may include one or more releasable fasteners for a releasable coupling to the impact-attenuation sub-layer 300. Accordingly, the impact-attenuation sub-layer 300 may be coupled and decoupled with the base-layer garment 400 as desired or needed by the athlete. The impact-attenuation sub-layer 300 may also be attached to the base-layer garment 400 before the base-layer garment 400 is donned, such that the combination of the base-layer garment 400 coupled with the impact-attenuation sub-layer 300 may be donned or put on at the same time. The impact-plate assembly 200 may be positionable over the impact-attenuation sub-layer 300, such that at least part of the impact-attenuation sub-layer 300 is nested beneath shoulder portions of the impact-plate assembly 200. As can be appreciated, the impact-plate assembly 200 might be overlaid atop the impact-attenuation sub-layer 300 either before the athlete dons the impact-attenuation sub-layer 300 and base-layer garment 400, or while the impact-attenuation sub-layer 300 and base-layer garment 400 are being worn.

The impact-plate assembly 200 and the impact-attenuation sub-layer 300 may be substantially retained in a particular position or arrangement using various features. For example, the securing garment 500 may be overlaid atop the impact-plate assembly 200 and coupled to other portions of the shoulder-pad system 100, to other garments (e.g., pants, belt, base layers, etc.), to the athlete, or any combination thereof. The securing garment 500 is depicted as a bib garment (or a tank-style garment), and other aspects of the disclosure may include a number of other suitable upper-body garments for securing the impact-plate assembly 200. The securing garment 500 may then be attached to one or more various anchor points on the impact-plate assembly 200, on other garments (e.g., pants, belt, etc.), on the athlete, or any combination thereof. In addition, the discrete shoulder sleeves 600A and 600B are each securable around a portion of an arm of the athlete, as well as to a respective portion of the impact-plate assembly, such as to an epaulette plate (e.g., 204) of the impact-plate assembly, a respective shoulder-cap (e.g., 304) of the sub-layer, or both the epaulette plate and the shoulder-cap. In this respect, the discrete shoulder sleeves 600A and 600B are also securing garments that function to couple various portions of the shoulder-pad system 100 together and to the athlete.

Referring briefly to FIG. 19 and FIG. 20, an aspect of the shoulder-pad system 100 is depicted and includes one or more first garment anchors 224 and one or more second garment anchors 554. For example, in some aspects of the disclosure, the anterior plate portion 207 may include the one or more first garment anchors 224. The one or more first garment anchors 224 may comprise a first lateral slot (obscured from view) extending through the left anterior plate 210 and a second lateral slot 232 extending through the right anterior plate 208. The first lateral slot may slidably receive a left-side lateral panel that extends form the posterior panel of the securing garment 500, and the second lateral slot 232 may slidably receive the distal portion 525 of the other lateral panel 524. In the illustrated aspect depicted in FIG. 20, the distal portion 525 of the other lateral panel 524 is threaded through the second lateral slot 232 and is coupled back onto an outward facing surface 502 of the panel 524. The left lateral side of the system may include a similar configuration. In this sense, the one or more second garment anchors 554 include the first and second posterior lateral panels 524, and the one or more first garment anchors 224 include the slots 232 extending through the anterior portion 207 of the plate assembly. The one or more first garment anchors 224 and the one or more second garment anchors may couple the securing garment 500 to the impact-plate assembly 200 to allow the securing garment 500 to hold the shoulder-pad system 100 in the as-worn position. For example, when the securing garment 500 and the impact-plate assembly 200 are in the as-worn position, the one or more first garment anchors 224 and the one or more second garment anchors 554 may restrain the impact-plate assembly 200 in at least the forward, rearward and lateral directions.

The shoulder-pad system 100 may be described as modular, in that the various subcomponents may be added to, and/or removed from, the system when it is desirable to do so. In addition, the system is modular in the sense that one or more subcomponents may be selectively repositioned within the system without necessarily affecting a portion or function of other subcomponents. As such, the system may include one or more layers or sub-layers that are modular.

The one or more subcomponents of the shoulder-pad system 100 may be utilized in various contexts. For instance, the entire system 100 may be worn in certain circumstances, and in other occasions, only some of the subcomponents may be worn. For example, the base-layer garment 400 might initially be positioned onto an athlete, and one or more subcomponents may or may not be layered onto the base-layer garment 400 depending on the activity. If the athlete is engaging in warm-ups, conditioning, or non-contact drills, then the athlete may not layer the impact-attenuation sub-layer 300 onto the base-layer garment 400. Further, it may be desirable in other instances to include the impact-attenuation sub-layer 300 without the impact-plate assembly 200, such as in a 7-on-7 drill or other light-contact drills.

The various subcomponents each includes certain features and functionality that arise from the sub-component independently, as well as the synergistic interaction of the sub-component with one or more other subcomponents.

Some of these aspects of the technology are generally described in this portion of the disclosure, and they will be described in more detail in other portions of the Specification. For example, one or more of the subcomponents may provide an amount of range of motion for a wearer, such as a shoulder range of motion or an arms-overhead range of motion. In addition, one or more of the subcomponents may provide system-stability features that improve the ability of the subcomponents to attenuate an impact and to remain in, or easily return to, a pre-impact state or arrangement. Additional features of the subcomponents may reduce or alleviate some maintenance often performed on more traditional padding systems, as well as improve the launderability of the subcomponents. Furthermore, one or more of the subcomponents may be customizable to a particular athlete or group of athletes. These features and functionality, as well as others, of the shoulder-pad system 100 and the various subcomponents will be described in additional detail in other parts of this disclosure.

Aspects of an Exemplary Impact-Attenuation Sub-Layer

Figure 5:
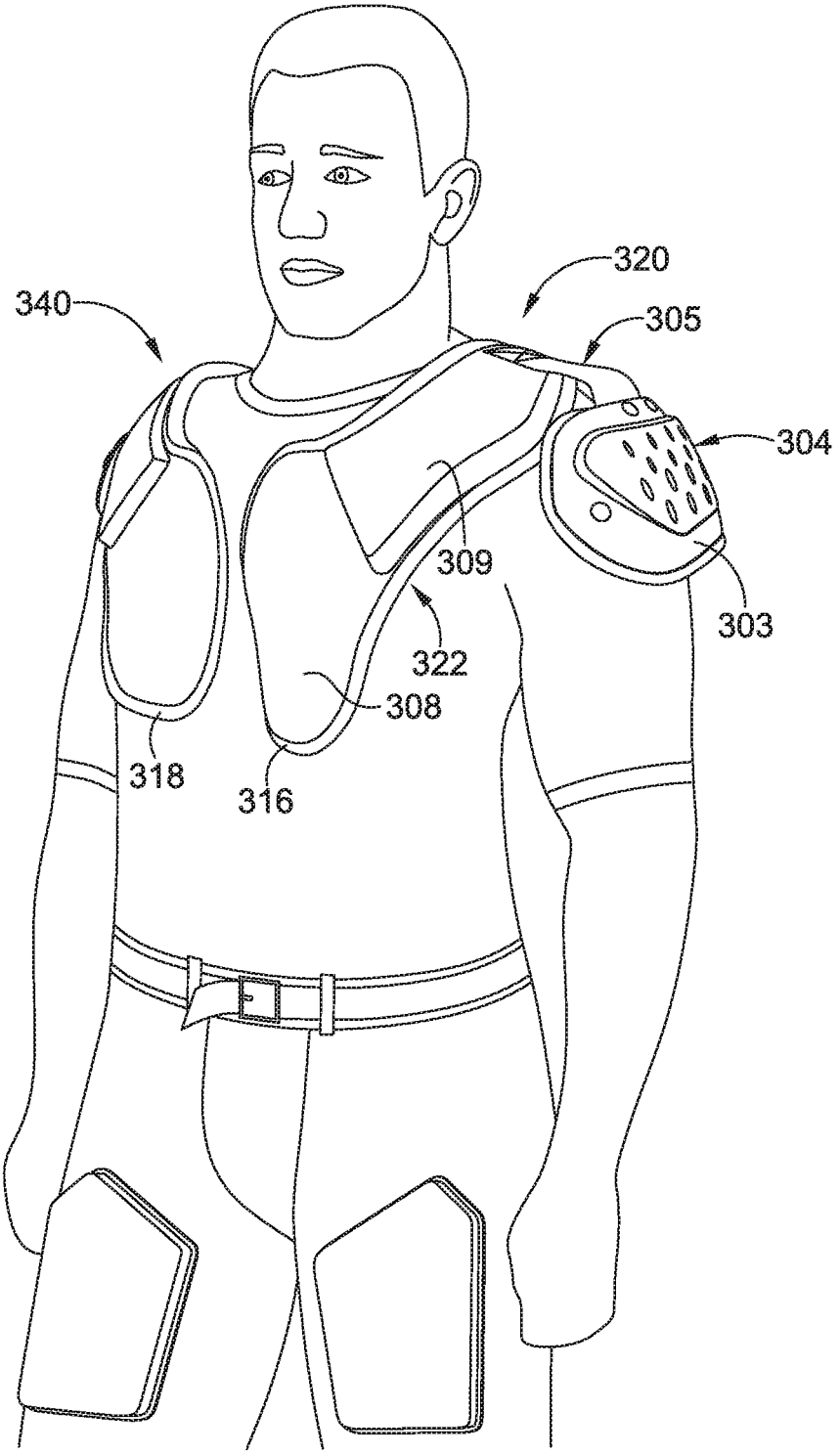
FIG. 5 depicts a front-perspective view of an impact-attenuation sub-layer, in accordance with an aspect hereof.
Figure 6:
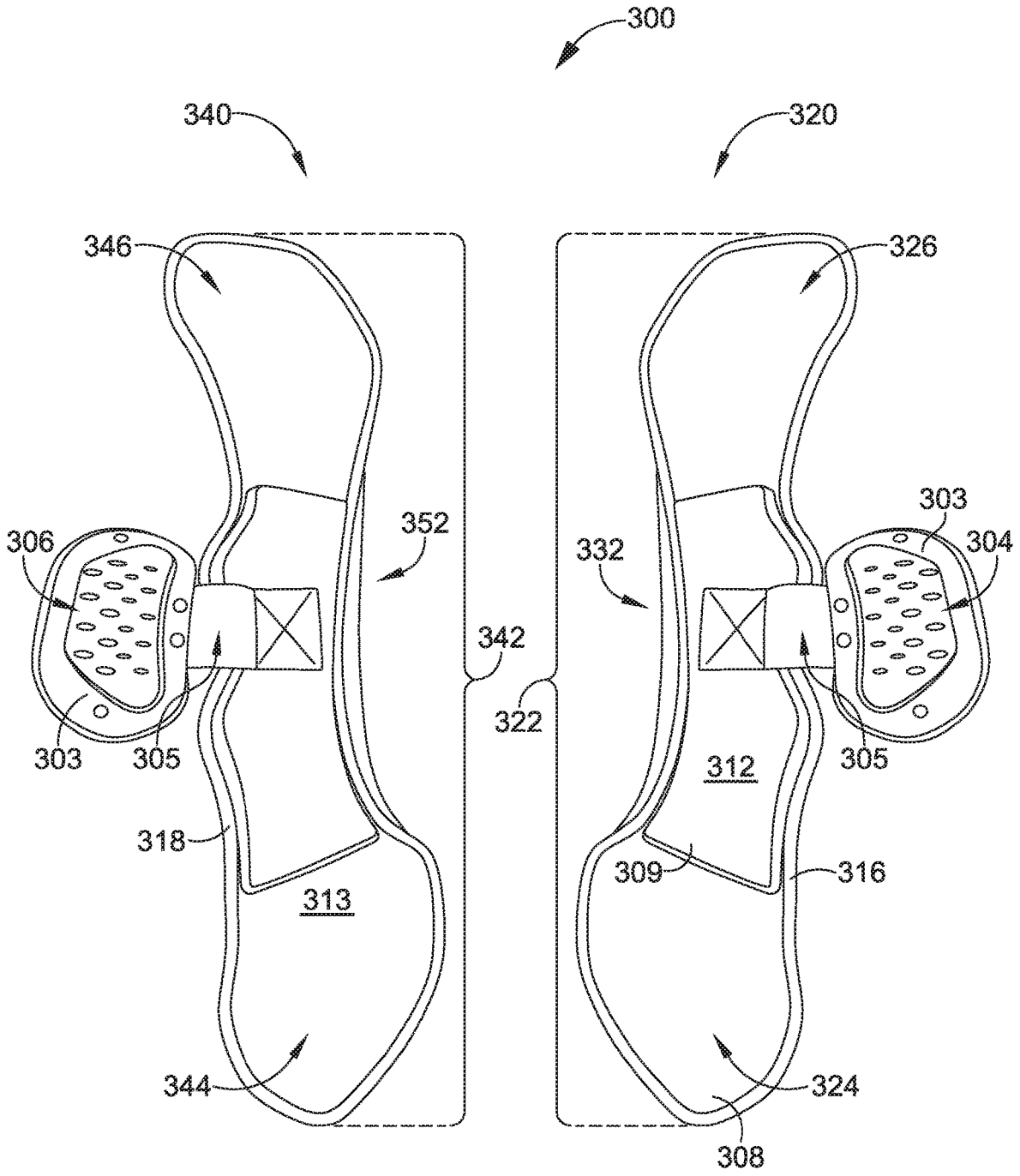
FIG. 6 depicts a top-down view of the impact-attenuation sub-layer, in accordance with an aspect hereof.

Having provided an overview of the aspects described herein, the impact-attenuation sub-layer will now be described in more detail. As shown in FIGS. 5 and 6, the impact-attenuation sub-layer 300 may include a pair of impact-attenuation components 320 and 340. The pair of impact-attenuation components 320 and 340 includes a first impact-attenuation component 320 and a second impact-attenuation component 340. The first impact-attenuation component 320 corresponds to a left side of the shoulder-pad system, and the second impact-attenuation component 340 corresponds to a right side of the shoulder-pad system.

In some aspects, the impact-attenuation components 320 and 340 are mirror images of one another, such that a description of one of the components may equally apply to the other component. For ease of readability, in some instances only one of the components may be described, and it is to be understood that the same description may also apply to the other one of the impact-attenuation components.

Each of the first and the second impact-attenuation components 320 and 340 includes a cushioning component coupled to a shoulder-cap component. For example, the first impact-attenuation component 320 includes a cushioning component 322 coupled to a shoulder-cap component 304. The cushioning component 322 may include various features and may be constructed of various materials. For example, the cushioning component may include various polymer foam materials that return to an original shape after being compressed. Examples of suitable polymer foam materials include polyurethane, ethylvinylacetate, polyester, polypropylene, and polyethylene foams. Moreover, both thermoplastic and thermoset polymer foam materials may be utilized. In some configurations, cushioning component 322 may be formed from a polymer foam material with a varying density, or solid polymer or rubber materials may be utilized. Fluid-filled chambers may also be utilized. Further, the cushioning component 322 may include one or more layers of cushioning material that is coupled between outer textile layers, and the cushioning component 322 may include apertures or grooves to enhance breathability and flexibility.

The cushioning component 322 may be interposed beneath the impact-plate assembly 200 when the shoulder-pad system is assembled, such that the cushioning component 322 may dampen forces imparted on the impact-plate assembly 200 during an impact, as well as provide other functionality. Also, different pad components, or portions of pad components, may be formed from different materials, or may be formed from similar materials with different densities. By selecting thicknesses, materials, and densities for each of the various cushion components, the degree of impact force attenuation may be varied throughout the system to impart a desired degree of cushioning or protection. For instance, the cushioning component 322 includes various portions or regions bound by a perimeter edge 316, such as a first padding portion 308 and a second padding portion 309. The padding portions may be disposed at locations that commonly receive impact, for example, at a location corresponding to the shoulder, chest, latissimus dorsi, trapezius, and the like. In addition, the padding portions 308 and 309 may include respective thicknesses or other properties that are selected to provide a particular amount of force attenuation in a particular region. For example, the second padding portion 309 may be thicker than the first padding portion 308 in instances or contexts in which the shoulder region is expect to receive larger, or more frequent, impacts than the chest region.

The cushioning component 322 includes the perimeter edge 316 that forms a boundary around the cushioning component 322. The perimeter edge 316 may be heat sealed, stitched, or otherwise finished to form a discrete padding component. In an aspect of this disclosure the perimeter edge 316 of the cushioning component 322 is discontinuous with, and not connected to, the perimeter edge 316 of the cushioning component 342. As briefly described hereinabove, these discrete units may allow one portion of the system 100 to move independently of other portions of the system, and this independent movement may positively affect range-of-motion and system-stability features (e.g., upon impact).

In FIG. 6, a relatively flattened (as compared to FIG. 5) and top-down view of the impact-attenuation sub-layer 300 is depicted, including the first impact-attenuation component 320 and the second impact-attenuation component 340. FIG. 6 illustrates an outward-facing surface 312 of the cushioning component 322 that would face away from the base-layer garment 400 when the first impact-attenuation component 320 is worn and would face towards the impact-plate assembly 200. The cushioning component 322 further includes an anterior portion 324 and a posterior portion 326. Similarly, the second cushioning component 342 includes an outward-facing surface 313, an anterior portion 344, and a posterior portion 346. When worn, the anterior portions 324 and 344 would be generally positioned near the anterior portion of the athlete, such as near the chest region, and the posterior portions 326 and 346 would be generally positioned near the posterior of the athlete, such as near the back region. Additionally, the first cushioning component 322 and second cushioning component 342 may include a first-cushion shoulder yoke 332 and a second-cushion shoulder yoke 352. The cushion shoulder yokes 332 and 352 include a portion of the cushioning components 322 and 342 that connects the anterior portion to the posterior portion (e.g., 324 to 326, and 344 to 346).

As previously explained, the impact-attenuation components 320 and 340 also include a shoulder-cap component. As such, the first impact-attenuation component 320 includes a shoulder-cap component 304 coupled to the first cushioning component 322, and the second impact-attenuation component 340 includes a shoulder-cap component 306 coupled to the second cushioning component 342. The shoulder-cap component 304 is coupled to the cushioning component 322 by a hinge attachment mechanism 305, or other suitable attachment mechanisms. For example, the hinge attachment mechanism 305 may be a material strip constructed from a durable and flexible material, such that the shoulder-cap component 304 may hingedly flex relative to the cushioning component 322. Furthermore, the shoulder-cap component 304 is coupled to the cushioning component 322 such that the shoulder-cap component 304 extends outward and away from the perimeter edge 316 of the cushioning component 322. The shoulder-cap may be padded or cushioned, similar to the cushioning component 322, to dampen impacts at the upper arm and shoulder of the athlete. Additionally, the shoulder-cap component 304 includes an impact plate 303, which may be constructed of a rigid material(s), similar to those used for the impact-plate assembly 200, and the impact plate 303 makes up part of the outward-facing surface of the first impact-attenuation component 320. Absent the present technology, in which the shoulder-cap component 304 is coupled to the cushioning component 322, the shoulder-cap component is sometimes attached to the impact-plate assembly 200. However, attaching the shoulder-cap component 304 to the cushioning component 322 can reduce binding and movement restriction that sometimes occurs when the shoulder-cap component 304 is coupled to the impact-plate assembly 200 as an athlete raises his or her arms overhead.

Figure 7:
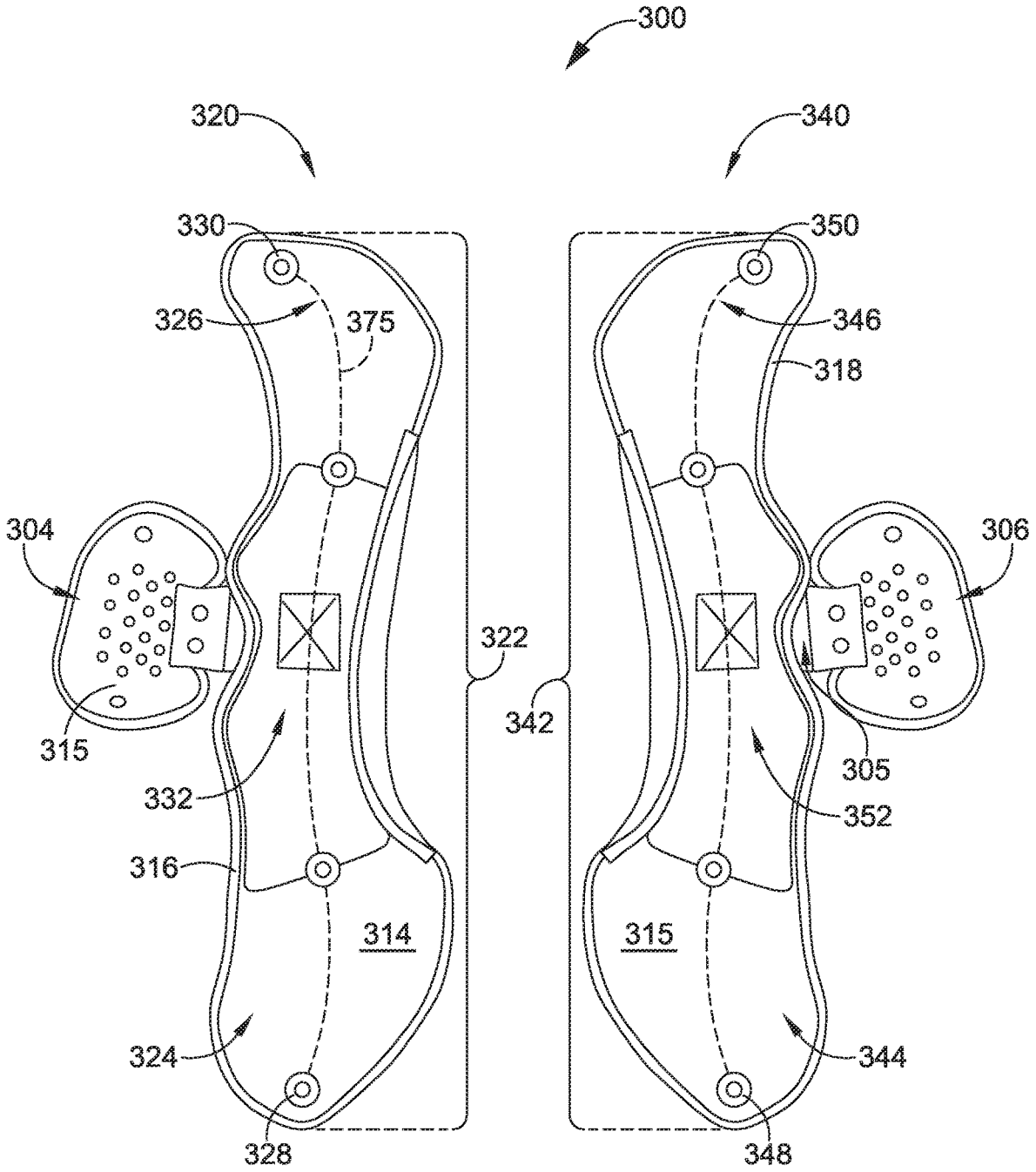
FIG. 7 depicts a bottom-up view of the impact-attenuation sub-layer depicted in FIG. 6, in accordance with an aspect hereof.

Referring now to FIG. 7 a bottom view of the impact-attenuation sub-layer 300 is illustrated that depicts inward-facing surfaces 314 and 315 of the first and second cushioning components 322 and 342, respectively. The inward-facing surfaces 314 and 315 are opposite to the outward-facing surfaces 312 and 313, depicted in FIG. 6, and are opposite to the impact plate 303 of the shoulder-cap components. The orientation of the impact-attenuation sub-layer 300 has been rotated horizontally 180°, relative to FIG. 6. Many of the same features that were described with respect to FIG. 6 are again illustrated in FIG. 7, such as the perimeters 316 and 318, anterior portions 324 and 344, posterior portions 326 and 346, and shoulder yokes 332 and 352.

As mentioned above, the impact-attenuation sub-layer 300 may include one or more releasable fasteners that are effective to releasably couple the impact-attenuation sub-layer 300 to the base-layer garment 400, and in one aspect, releasable fasteners may be positioned on the inward-facing surfaces 314 and 315 of FIG. 7. Examples of releasable fasteners include male-female couplings (e.g., snaps, stud-socket, etc.), buttons, hook-and-loop fasteners, zipper fasteners, rail-and-slot arrangements, belts, and the like. The releasable fasteners may be positioned in various portions or regions of the first and second cushioning components 322 and 342, such as in the anterior portions 324 and 344, the posterior portions 326 and 346, the shoulder yokes 332 and 352, and any combination thereof. As such, the impact-attenuation sub-layer 300 may include an anterior releasable fastener and a posterior releasable fastener on the first cushioning component 322, and an anterior releasable fastener and a posterior releasable fastener on the second cushioning component 342.

FIG. 7 illustrates one aspect in which the impact-attenuation sub-layer 300 includes stud components 328, 330, 348, and 350 affixed to various portions of the first and second impact-attenuation components. As such, the first cushioning component 322 includes a first-cushion anterior releasable fastener 328 and a first-cushion posterior portion releasable fastener 330, and the second cushioning component 342 includes a second-cushion anterior releasable fastener 348 and a second-cushion posterior releasable fastener 350.

Figure 8:
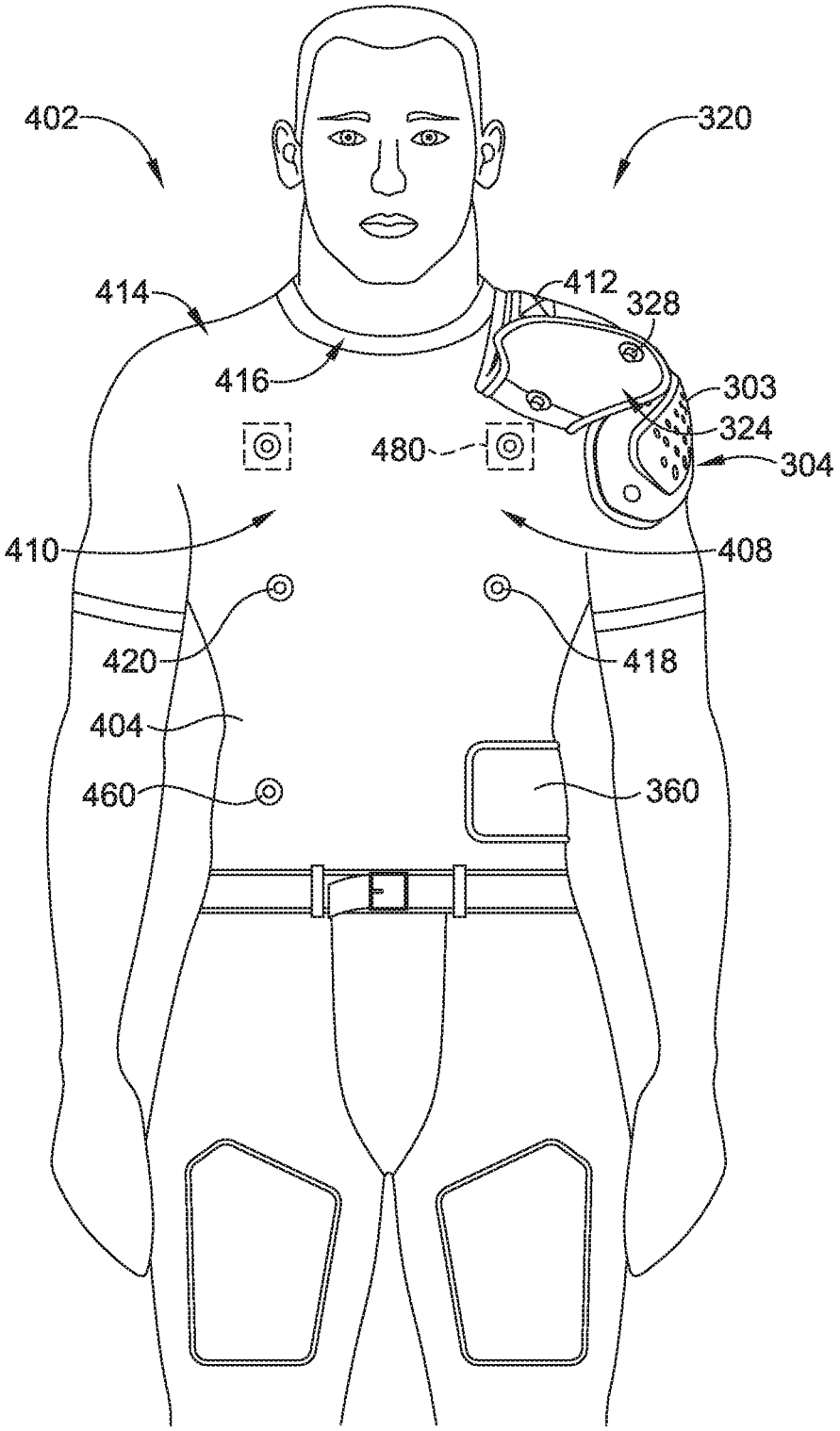
FIG. 8 depicts a front view of at least a portion of a shoulder-pad system having a base-layer garment and an impact-attenuation sub-layer, in accordance with an aspect hereof.

Referring to FIG. 8, as previously described the shoulder-pad system 100 may include a garment, for example a base-layer garment 400. The garment 400 may be constructed of one or more textiles and may have various properties. For example, the garment 400 may be made from woven, knit, or non-woven materials having varying breathability, moisture-wicking, and/or ventilation properties, and may include mesh and/or perforated panels for zoned breathability and/or zoned performance in other textile-performance categories (e.g., wicking, loft, insulation, texture, moisture control, and the like). In addition, the garment 400 may include various degrees of stretch or elasticity to achieve a desired amount of compression. The garment may function in various capacities, including a base layer, a mid-layer, an outer layer, a jersey, and any combination thereof. As such, the garment may include player-identifying indicia in certain possibly exposed areas (e.g., numbers, names, team logo, etc.).

The base-layer garment 400 includes one or more releasable fasteners that correspondingly mate with the releasable fasteners of the impact-attenuation sub-layer 300. As shown in FIG. 8, the base-layer garment 400 includes a shirt body 402 having an anterior portion 404 and a posterior portion (shown as posterior portion 406 in FIG. 9). Each of the anterior portion 404 and the posterior portion 406 includes a first lateral side 408 (i.e., left side) and a second lateral side 410 (i.e., right side). The shirt body 402 includes a first shoulder yoke 412 (which is at least partially obscured from view by the first cushioning component 322) and a second shoulder yoke 414 connecting the anterior portion 404 to the posterior portion 406. Accordingly, the shirt body 402 may include a neck receiving opening 416 that is formed by the first shoulder yoke 412 and the second shoulder yoke 414 and the anterior and posterior portions.

Figure 9:
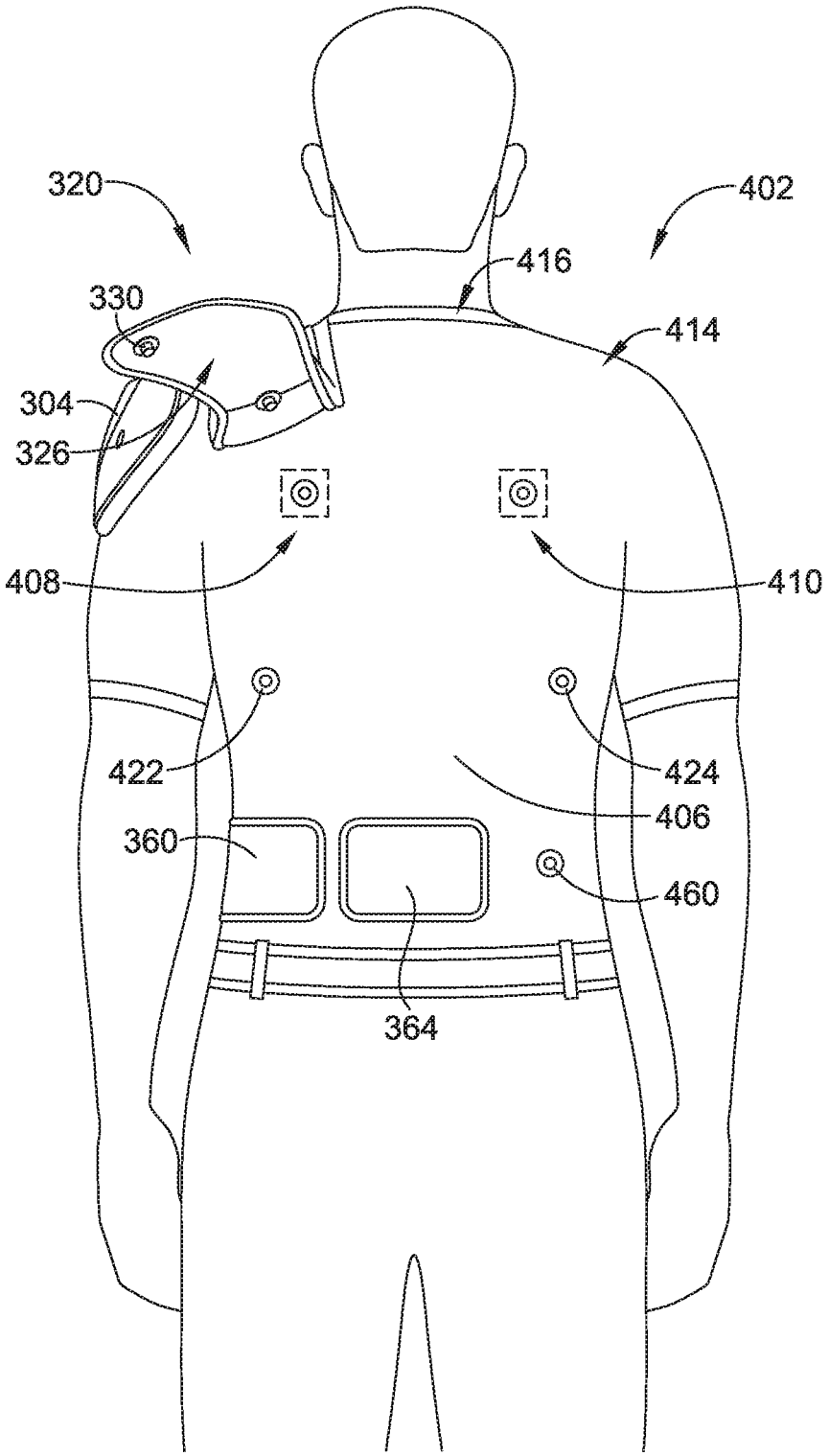
FIG. 9 depicts a back view of the system of FIG. 8 in accordance with an aspect hereof.

The base-layer garment 400 includes releasable-fastener components that are configured to, and positioned to, releasably mate with the releasable-fastener components of the impact-attenuation sub-layer 300. For example, the garment 400 includes a first anterior releasable fastener 418 at the first lateral side 408, and a second anterior releasable fastener 420 at the second lateral side. The first anterior releasable fastener 418 releasably mates with the first-cushion anterior releasable fastener 328, and the second anterior releasable fastener 420 releasably mates with the second-cushion anterior releasable fastener 348 (see FIG. 7). Furthermore, as depicted in FIG. 9, the garment 400 includes a first posterior releasable fastener 422 at the first lateral side 408, and a second posterior releasable fastener 424 at the second lateral side 410. The first posterior releasable fastener 422 releasably mates with the first-cushion posterior releasable fastener 330, and the second posterior releasable fastener 424 releasably mates with the second-cushion posterior releasable fastener 350 (see FIG. 7). These depicted positions of the various releasable fasteners are for exemplary purposes, and the releasable fasteners may be positioned in alternative, or additional, positions in order to releasably attach the impact-attenuation sub-layer to the garment 400.

FIGS. 7-9 depict one aspect in which the impact-attenuation sub-layer 300 is releasably affixed to the garment 400 by way of a male-and-female coupling. For example, FIGS. 8 and 9 depict male components (e.g., stud) on the first cushioning component 322 and female components (e.g., socket) on the garment 400. However, the male components might alternatively be integrated into the garment 400 and the female components might be integrated into the cushioning components.

In one aspect, the garment 400 may include one or more sensors (e.g., 480) configured to measure one or more biometric indicators (e.g., heart rate, body temperature, perspiration amounts, perspiration content, hydration levels, etc.), and the sensors may be integrated with the releasable coupling of the garment. Furthermore, the cushioning components 322 and 342 may include telemetry (e.g., including wiring 375) that is integrated with the releasable coupling of the cushioning components and that is configured to transmit electronic signals to one or more processing units and/or data-storage devices. For instance, the shoulder-pad system may include an electronic controller coupled to the posterior plate of the impact-plate assembly. As such, the male-and-female coupling provides a signaling conduit between one or more biometric sensors and the telemetry.

In another embodiment, cushioning components 322 and 342 may include one or more fluid-communication channels for transferring a fluid from a fluid source to various regions of the pad. For example, the fluid-communication channels may be configured to transmit conditioned air or moisture (e.g., water) to various parts of the system 100 to aid in cooling or warming a skin surface, to aid in physiological recovery, or for some other benefit. For example, the grooves may be constructed into the inward facing surfaces 314 and 315 in a manner similar to that described in co-owned application U.S. Ser. No. 13/747,974, which is incorporated herein by reference in its entirety.

Additionally, the impact-attenuation sub-layer 300 may include one or more extension cushioning components 360. The extension cushioning components 360 may include releasable fasteners, similar to those described hereinabove with reference to cushioning components 322 and 342. The releasable fasteners may be configured to mate with one or more base-layer extension cushioning component releasable fasteners 460. Additionally, a lumbar extension cushioning component 364 is depicted. The base-layer garment 400 may be constructed from one or more textile layers.

Figure 17:
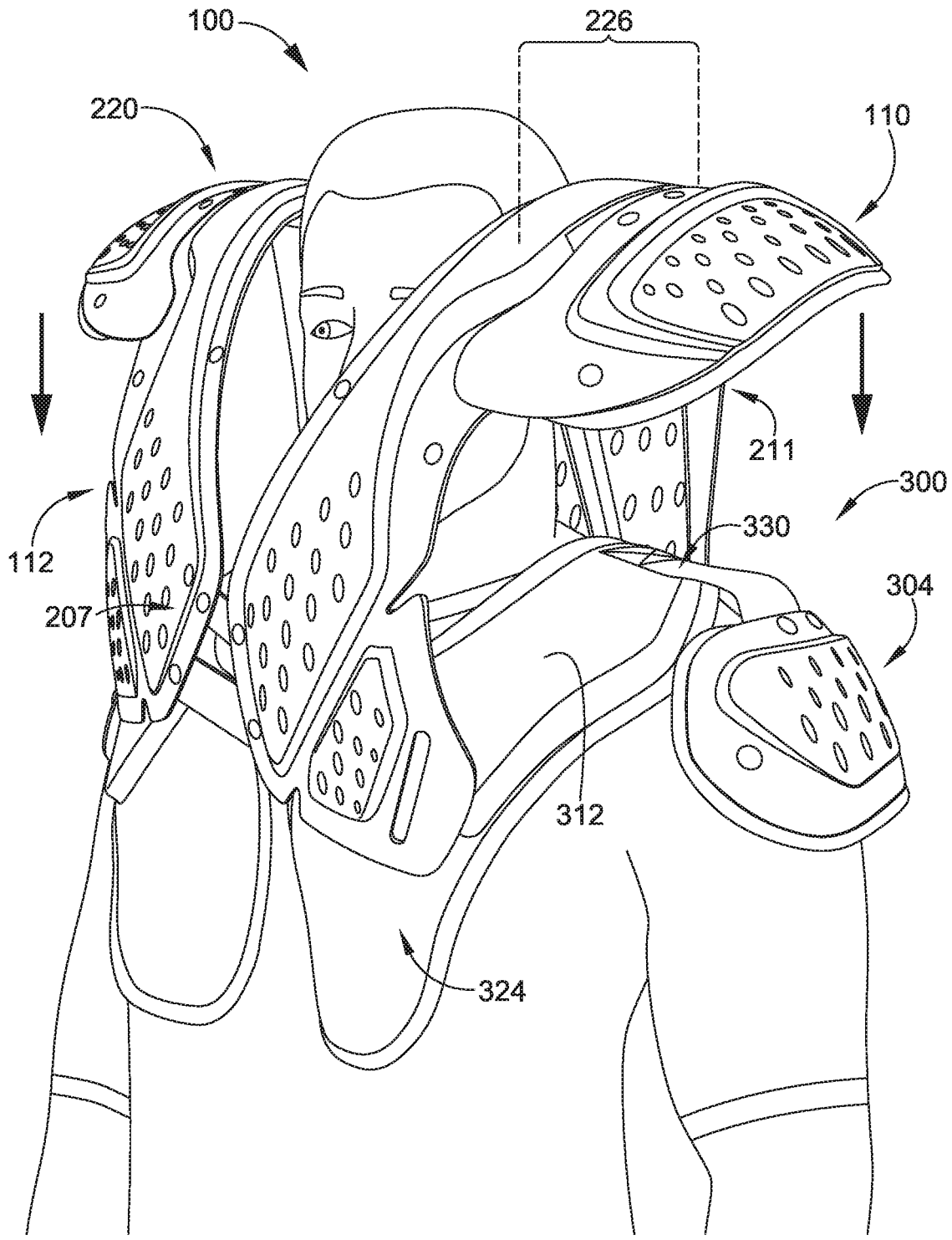
FIG. 17 depicts at least a portion of another shoulder-pad system in which an impact-plate assembly is positioned above an impact-attenuation sub-layer, in accordance with an aspect hereof.

Referring now to FIG. 17, at least part of the shoulder-pad system 100 is depicted, including the impact-attenuation sub-layer 300 positioned underneath an impact-plate assembly 200. The shoulder-pad system 100 generally includes a first lateral side 110 (or left lateral side) and a second lateral side 112 (or right lateral side), the first and second lateral sides 110 and 112, respectively, being substantially mirror-image constructions of one another. Each of the first and second lateral sides 110 and 112, respectively, includes respective portions of the impact-attenuation sub-layer 300, such as the first impact-attenuation component 320 and the second impact-attenuation component 340. As described hereinabove, each of the impact-attenuation components 320 and 340 include a cushioning component (e.g., 322 and 342) and a shoulder-cap component 304 (and 306). Additionally, the cushioning components include a first surface 312 and a second surface (see e.g., 314 in FIG. 7), the first surface 312 including an outward-facing surface that faces towards the impact-plate assembly 200. Further, the cushioning component 322 includes an anterior cushion portion 324, a posterior cushion portion (see e.g., element 326 in FIGS. 6 and 9), and a shoulder yoke 332 connecting the anterior cushion portion 324 to the posterior cushion portion. The shoulder-cap component 304 is hingedly coupled to the cushioning component 322 at the shoulder yoke 332.

The impact-plate assembly 200 includes an anterior plate assembly 207, a posterior plate assembly 211, and a shoulder assembly 220. In one aspect, the shoulder assembly 220 includes an arched frame 226 connecting the anterior plate assembly 207 to the posterior plate assembly 211, the arched frame 226 including a convex crown-side surface 216, and an opposite concave surface that opposes the convex crown-side surface (e.g., the opposite concave surface 218 of the right lateral shoulder assembly is labeled and the left lateral shoulder assembly would include a similar opposite concave surface underneath the convex surface 216). Accordingly, when the impact-plate assembly 200 is placed on top of the impact-attenuation sub-layer 300, the shoulder yoke 332 of the cushioning component is nested within the arched frame 226. Further, the first surface 312 of the cushioning component is layered directly against the concave surface of the arched frame 226.

As discussed hereinabove, in an aspect of this disclosure, the first surface 312 of the cushioning component 322 does not include any fasteners for coupling the impact-attenuation sub-layer 300 directly to the impact-plate assembly 200. As such, when the impact-plate assembly 200 shifts, such as upon impact, the impact-attenuation sub-layer 300 does not necessarily shift with the impact-plate assembly 200. Rather, the impact-attenuation sub-layer 300 is anchored to the garment 400, such that the impact-attenuation sub-layer 300 may not need to be adjusted post-impact (to the extent possibly needed had the impact-attenuation sub-layer 300 been affixed directly to the impact-plate assembly). The discrete nature of the impact-attenuation sub-layer may provide additional benefits as well that allow portions of the shoulder-pad system 100 to move independently of one another. For example, when an athlete raises a right arm in a throwing motion (or otherwise to perform a movement), the impact-attenuation component 340 corresponding to the right side of the athlete's body may also be raised, while the impact-attenuation component 320 corresponding to the left side of the athlete's body may remain in pre-arm-raise position.

Figure 10:
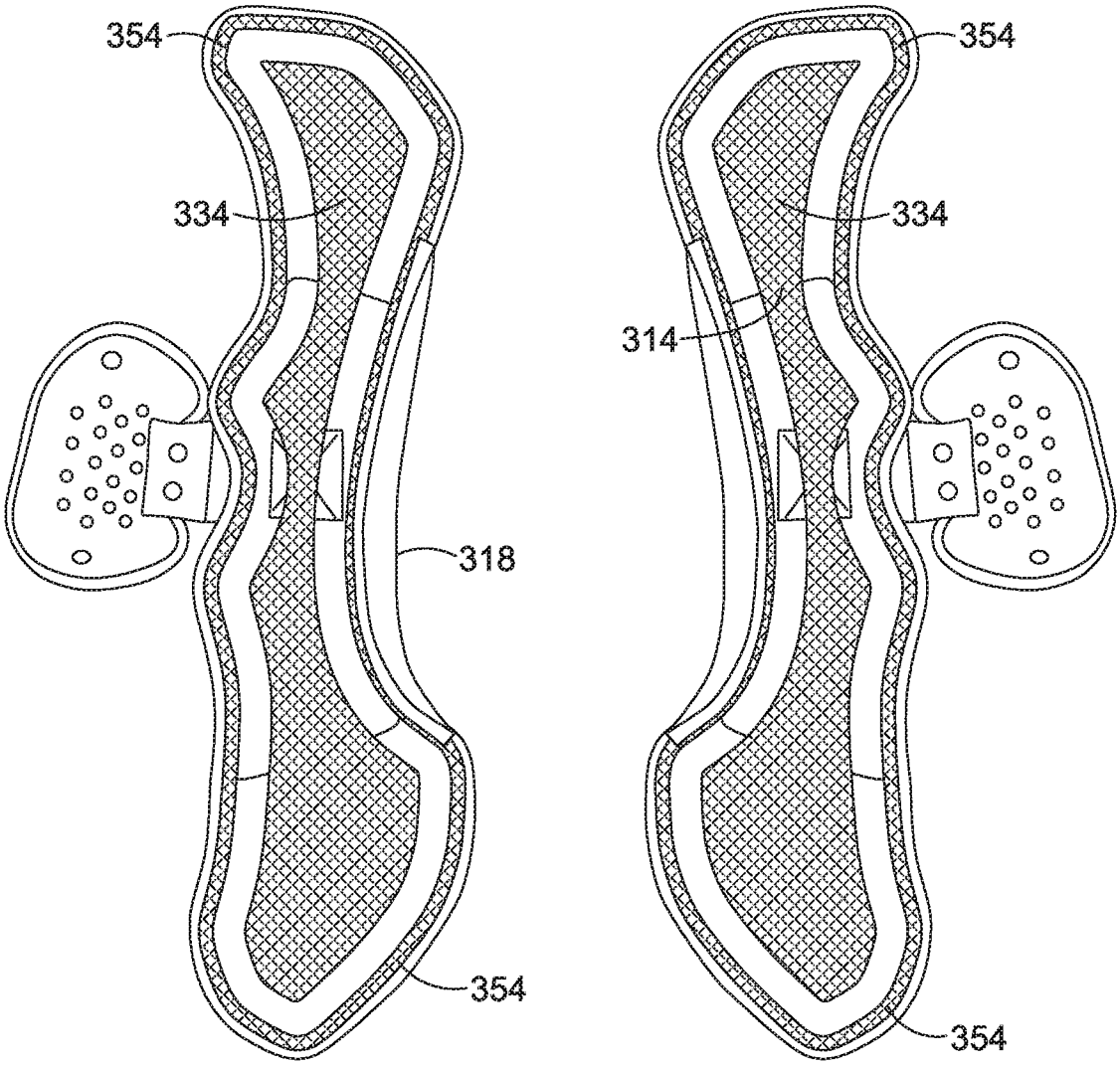
FIG. 10 depicts a bottom-up view of another impact-attenuation sub-layer, in accordance with an aspect hereof.

Aspects of Other Exemplary Impact-Attenuation Sub-Layers Having Alternative Releasable-Coupling Mechanisms Other releasable coupling mechanisms may be utilized to connect the impact-attenuation sub-layer 300 to the garment 400. Referring now to FIG. 10, inward-facing surfaces of impact-attenuation components are depicted. FIG. 10 is similar to FIG. 7, but FIG. 10 includes an alternative releasable coupling mechanism. For example, FIG. 10 illustrates a first hook-and-loop releasable fastener 334 and a second hook-and-loop releasable fastener 354. The location of the hook-and-loop releasable fasteners 334 and 354 in FIG. 10 is exemplary in nature and is not intended to be limiting. For example, in an alternate aspect, the inward-facing surface may comprise a releasable fastener or fasteners at any portion and/or location on the inward-facing surface. Additionally, the inward-facing surface may be made from a material that integrally incorporates the hook portions or loop portions as part of the surface.

Figure 11:
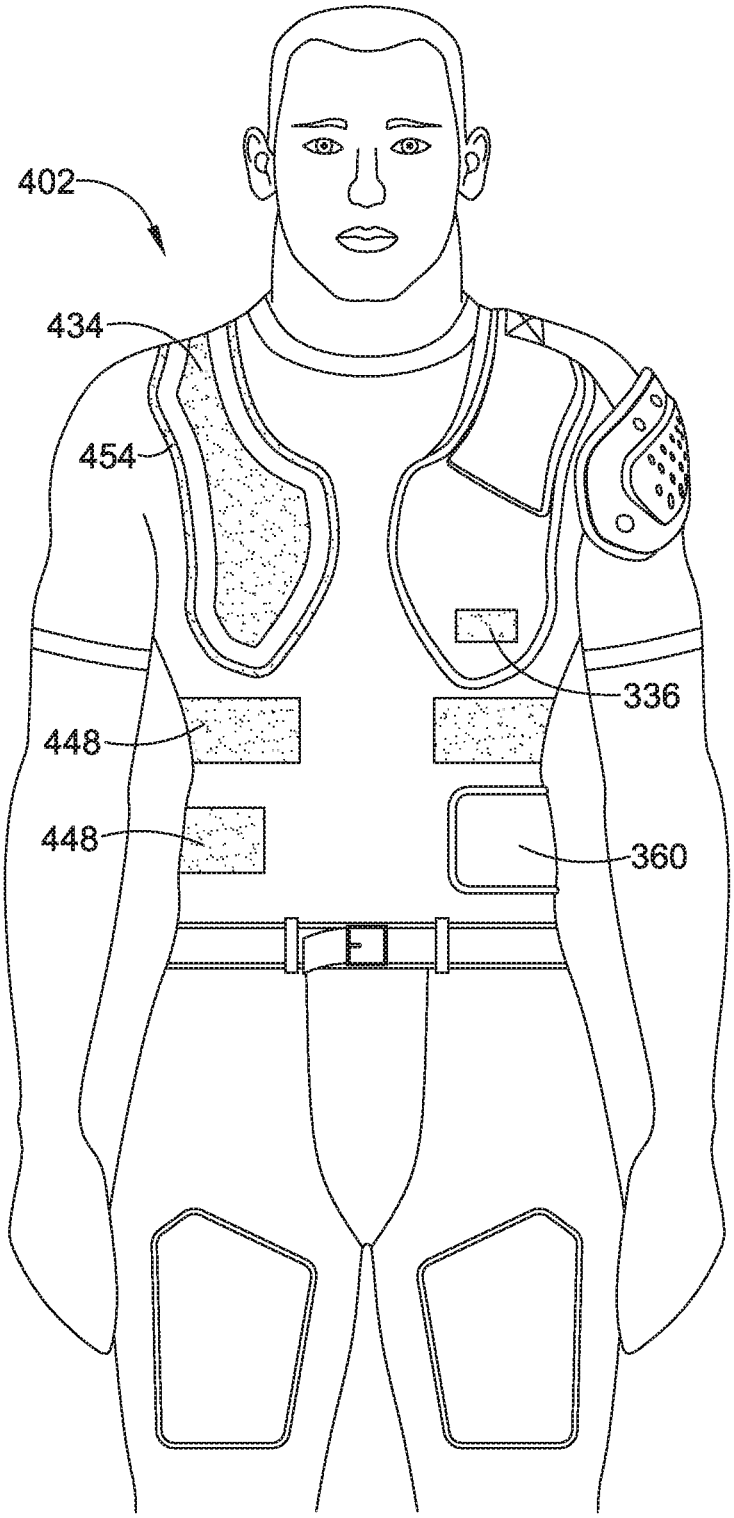
FIG. 11 depicts a front view of at least a portion of another shoulder-pad system including the impact-attenuation sub-layer of FIG. 10, in an as-worn position, in accordance with an aspect hereof.

FIG. 11 depicts a front view of a base-layer garment 400 having one or more releasable fasteners corresponding to the hook-and-loop releasable fasteners 334 and 354 described above with reference to FIG. 10. For example, the base-layer garment 400 may include a first base-layer hook-and-loop releasable fastener 434 and a second base-layer hook-and-loop releasable fastener 454. The first base-layer hook-and-loop releasable fastener 434 and the second base-layer hook-and-loop releasable fastener 454 may be configured to mate with the first hook-and-loop releasable fastener 334 and the second hook-and-loop releasable fastener 354. Additionally, the base-layer garment 400 may include one or more hook-and-loop extension cushioning component fasteners 448 for mating with the extension cushioning component 360.

As briefly mentioned hereinabove, the various subcomponents of the shoulder-pad system may be customizable to a particular athlete or group of athletes. For example, it may be desirable for an interior lineman to have larger and/or thicker impact-attenuation sub-layer components than those used by skill position players. Accordingly, the impact-attenuation sub-layer 300 may include one or more sub-layer extension cushioning component fasteners 336, such that one or more extension cushioning components 360 may be added to the impact-attenuation sub-layer 300 to increase the thickness.

Figure 12:
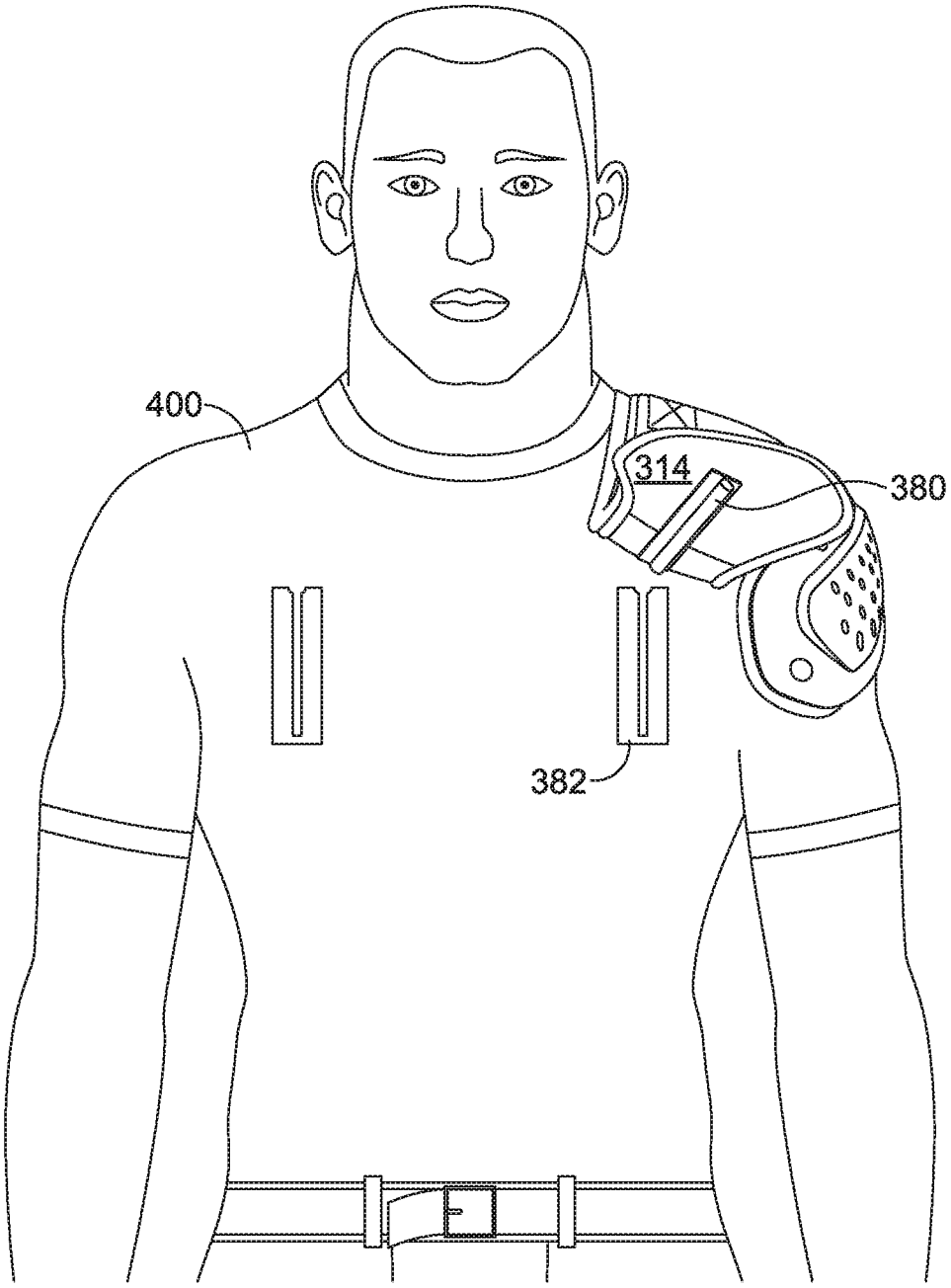
FIG. 12 depicts a front view of at least a portion of another shoulder-pad system including another impact-attenuation sub-layer and base layer, in accordance with an aspect hereof.

Referring now to FIG. 12, another aspect of the disclosure is illustrated that depicts another releasable coupling mechanism, including a slot-and-rail mechanism. That is, in FIG. 12, the inward-facing surface 314 of the impact-attenuation sub-layer includes a rail element 380 that slidably mates with a slot component 382 integrated into the outward-facing surface of the garment 400. FIG. 12 is merely exemplary, and the slot component 382 might alternatively be integrated on the inward-facing surface 314, and the rail component 380 might be integrated into the garment 400. As previously explained, the slot component 382 might be integrally constructed with one or more biometric sensors, such that the connection of the rail 380 and slot 382 provides a conduit for transferring a signal to other telemetry.

Figure 13:
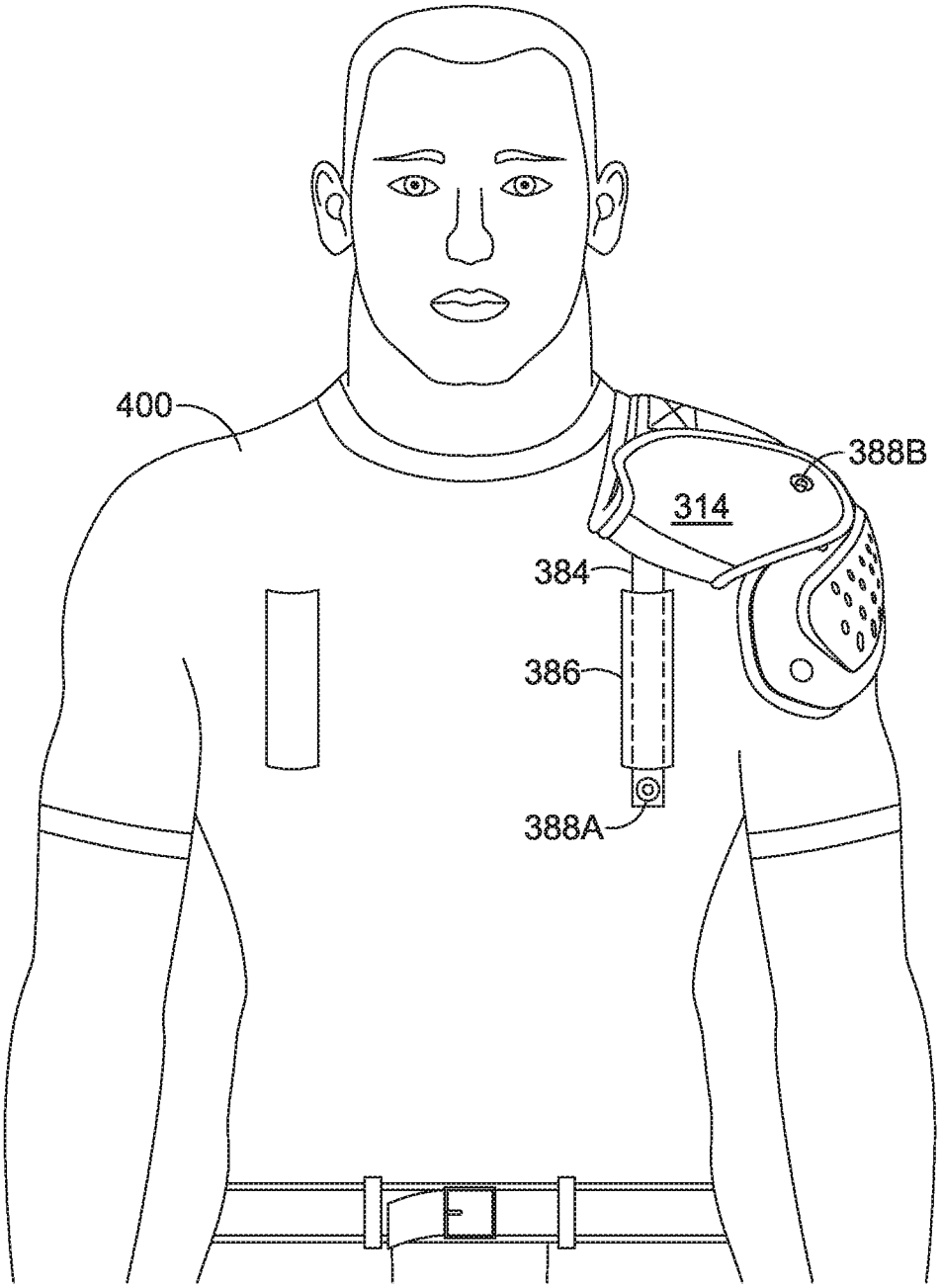
FIG. 13 depicts a front view of at least a portion of another shoulder-pad system including another impact-attenuation sub-layer and base layer, in accordance with an aspect hereof.

Referring now to FIG. 13, another aspect of the disclosure is illustrated that depicts another releasable coupling mechanism, including a belt-and-loop configuration. That is, in FIG. 13, the inward-facing surface 314 of the impact-attenuation sub-layer includes a belt element 384 that slidably mates through a loop component 386 integrated into the outward-facing surface of the garment 400. In addition, the belt element 384 includes releasable fasteners 388A and 388B for releasably connecting a portion of the belt 384 to the inward-facing surface 314 (e.g., snap, button, stud-and-socket, etc.). FIG. 13 is merely exemplary, and the loop component 386 might alternatively be integrated on the inward-facing surface 314, and the belt component 384 might be integrated into the garment 400.

Figure 14B:
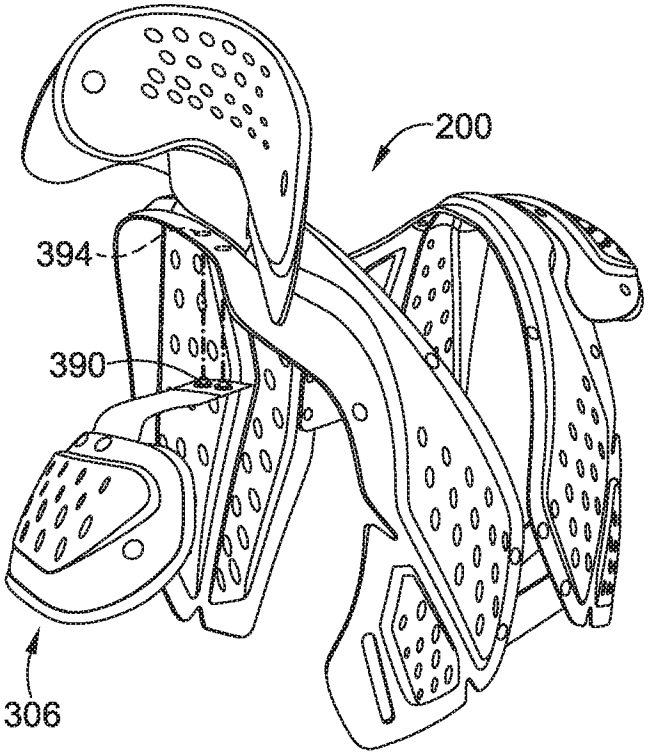
FIGS. 14A and 14B illustrate aspects of a modular shoulder cap, in accordance with an aspect hereof.
Figure 14A:
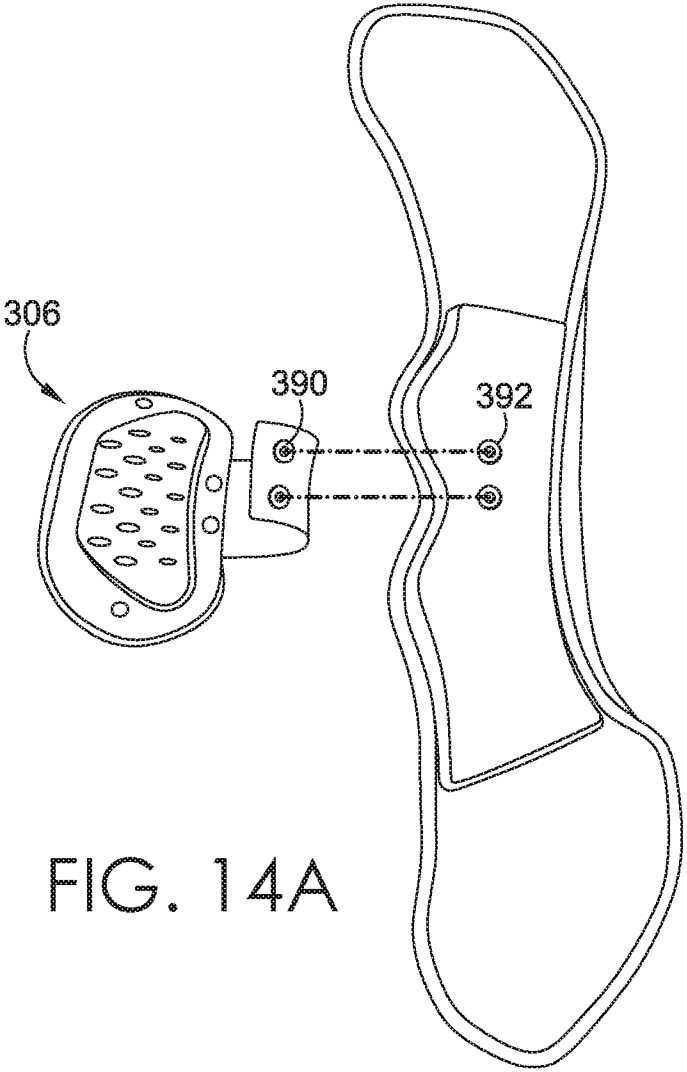

FIGS. 14A and 14B depict another aspect in which a shoulder-cap component 306 includes a releasable fastener 390 that allows the shoulder-cap component 306 to be releasably coupled to either a mating releasable fastener 392 on the cushioning component 342 or another mating releasable fastener 394 on the impact-plate assembly 200. For example, the releasable fastener 390 might include a female component that mates with a male component on the cushioning component 342, or might be a male component that mates with a female component on the cushioning component 342. In addition, the same male or female component on the shoulder-cap component 306 might also be attachable to a mating male or female component on the impact-plate assembly. Or alternatively, the releasable fastener 390 may include fastening hardware on both sides of the hinge attachment mechanism 305 (e.g., flexible strip), such that one set of hardware is connectable to the fastening component 392 and another set of the hardware is connectable to the fastening component 394.

Aspects of Other Exemplary Garments

Figure 15A:
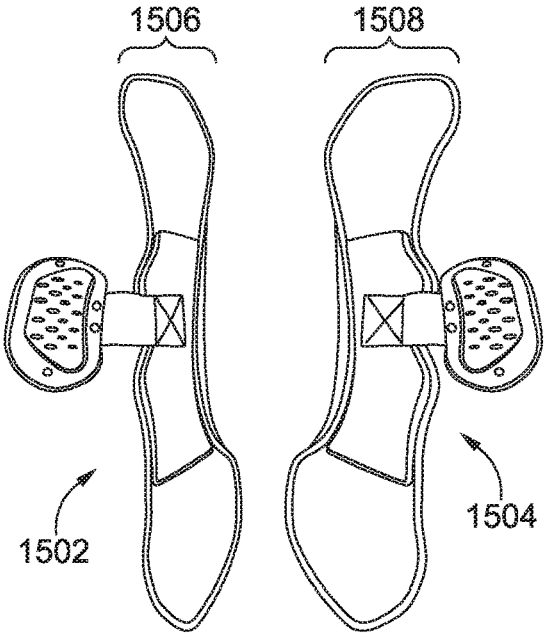
FIGS. 15A-15C each depicts a respective pair of impact-attenuation components having different characteristics, in accordance with an aspect of the present invention.
Figure 15B:
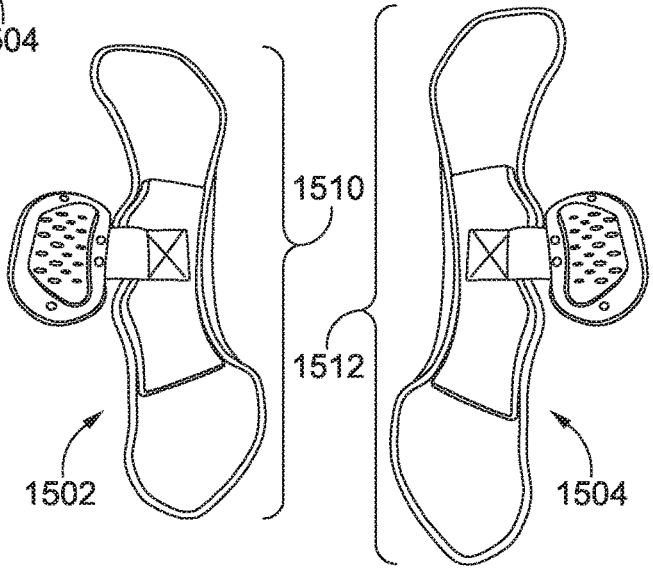
Figure 15C:
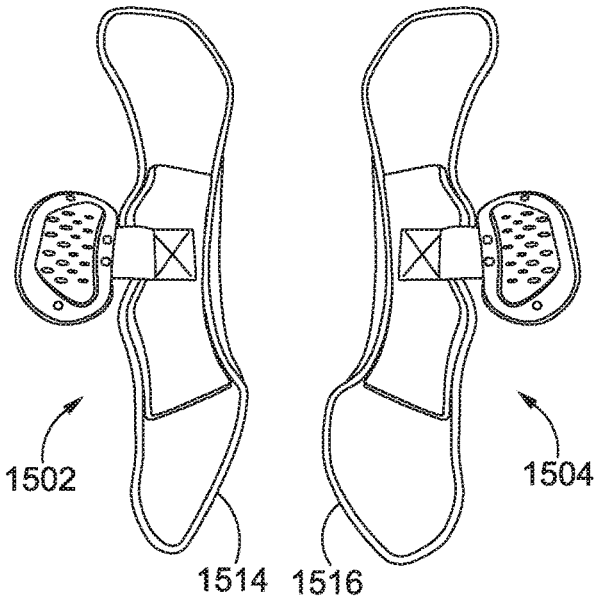

Referring now to FIGS. 15A-15C, another aspect of the disclosure is illustrated, and each of FIGS. 15A-15C includes a first impact-attenuation component 1502 and a second impact-attenuation component 1504. In addition, each of the impact-attenuation components includes a cushion component (similar to the cushioning components 322 and 342 in FIG. 6). In FIGS. 15A-15C the first impact-attenuation component 1502 has a first set of characteristics and the second impact-attenuation component 1504 has a second set of characteristics, the first set being different than the second set. Exemplary characteristics that might be included in the set of characteristics include a respective cushion-component width, a cushion-component length, a cushion-component profile, a cushion-component thickness, or any combination thereof. Other exemplary characteristics might include cushion-component breathability, elasticity, rigidity, flexibility, moisture wicking, material weight, density, and the like. Again, these are merely exemplary and other impact-attenuation components might have various other characteristics.

In FIG. 15A, the first impact-attenuation component 1502 includes a first width 1506 and the second impact-attenuation component 1504 includes a second width 1508, the first width 1506 being narrower than the second width 1508, such that the first and second impact-attenuation components have a different set of characteristics. In FIG. 15B, the first impact-attenuation component 1502 includes a first length 1510 and the second impact-attenuation component 1504 includes a second length 1512, the first length 1510 being shorter than the second length 1512, such that the first and second impact-attenuation components have a different set of characteristics. Further, in FIG. 15B, the first impact-attenuation component 1502 includes a first profile that is defined by the first perimeter edge 1514 and the second impact-attenuation component 1504 includes a second profile that is defined by the second perimeter edge 1516. The first profile has a different boundary shape than the second profile based on the different respective perimeter edges.

In an aspect of the disclosure, by incorporating impact-attenuation components having different characteristics into the same shoulder-pad assembly, the assembly can be customized for a particular athlete. For example, if an athlete performs a throwing motion with a right arm more than a left arm, then a right-side cushion component having a size and/or shape different from the left-side cushion component might be selected and used in the system to reduce possible equipment impediments to desired range of motion. In addition, if an athlete has an injured area on one side of his or her body, such as the left side, then a left-side cushion component having a size and/or shape different from the right-side cushion component might be selected and used in the system to provide additional protection to the injured area. These are examples of how an aspect of the disclosed subject matter might be modular.

Figure 16:
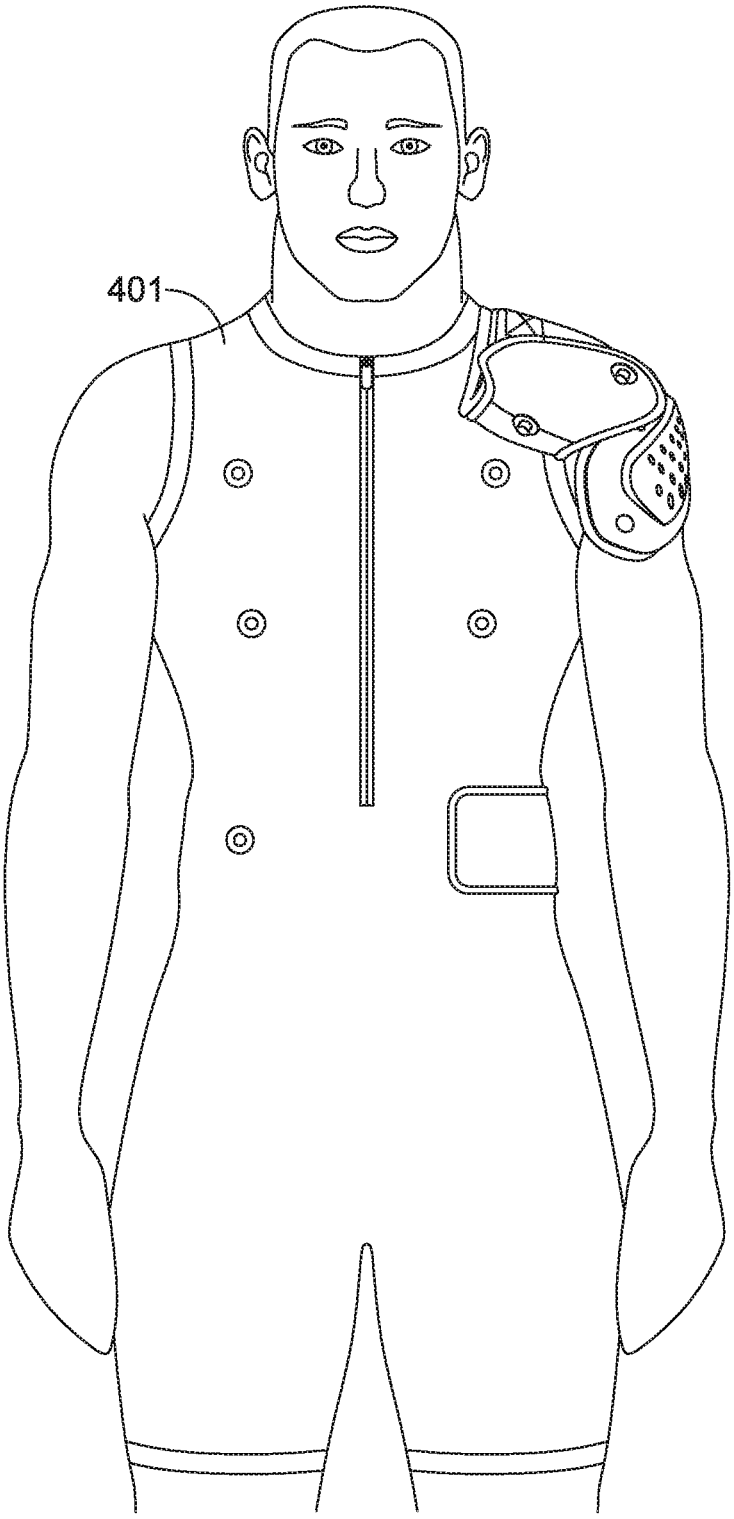
FIG. 16 depicts at least a portion of another shoulder-pad system including another impact-attenuation sub-layer and base layer, in accordance with an aspect hereof.

Referring now to FIG. 16, another exemplary base-layer garment 401 is illustratively depicted that may be coupled with the impact-attenuation sub-layer. Similar to the garments depicted in FIGS. 8 and 11-13, the garment 401 includes releasable attachment mechanisms for releasably attaching to an impact-attenuation sub-layer. In addition, the garment 401 includes an upper-body portion and a lower-body portion that are integrated into a single garment. The upper-body portion includes a zipper 403 that can be unzipped for donning and doffing the garment 401. However, any of a variety of other types of fasteners might be incorporated into the garment 401, such as buttons, snaps, and the like.

Although a male-and-female coupling is depicted for attaching the impact-attenuation sub-layer, any of the various other coupling mechanisms described herein might be utilized. In addition, although the garment 401 depicts a sleeveless upper-body portion, the garment 401 might include any length of sleeve, including short sleeves, three-quarter sleeves, or long sleeves. Similarly, the lower-body portion might include short pant-leg portions (as depicted), long pant-leg portions, or any length in-between.

From the foregoing, it will be seen that aspects herein are well adapted to attain all the ends and objects hereinabove set forth together with other advantages, which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

The invention claimed is:

1. An upper-body garment comprising:

a shirt body having an outward-facing surface, the shirt body comprising an anterior portion, a posterior portion, a first shoulder yoke, and a second shoulder yoke, the anterior portion, the posterior portion, the first shoulder yoke, and the second shoulder yoke being constructed of one or more textile layers;

a first anterior releasable fastener coupled to the anterior portion on a first lateral side of the outward-facing surface of the shirt body, a second anterior releasable fastener coupled to the anterior portion on a second lateral side of the outward-facing surface of the shirt body, a first posterior releasable fastener coupled to the posterior portion on the first lateral side of the outward-facing surface of the shirt body, and a second posterior releasable fastener coupled to the posterior portion on the second lateral side of the outward-facing surface of the shirt body;

a first impact-attenuation component having a first cushioning component and a first shoulder-cap component coupled to the first cushioning component, the first cushioning component comprising:

a first-cushion anterior portion, a first-cushion posterior portion, and a first-cushion shoulder yoke connecting the first-cushion anterior portion to the first-cushion posterior portion, a first inward-facing surface, the first-cushion anterior portion including a first-cushion anterior releasable fastener located on the first inward-facing surface, wherein the first-cushion anterior releasable fastener releasably mates with the first anterior releasable fastener, the first-cushion posterior portion including a first-cushion posterior releasable fastener located on the first inward-facing surface, wherein the first-cushion posterior releasable fastener releasably mates with the first posterior releasable fastener;

a second impact-attenuation component having a second cushioning component and a second shoulder-cap component coupled to the second cushioning component, the second cushioning component comprising:

a second-cushion anterior portion, a second-cushion posterior portion, and a second-cushion shoulder yoke connecting the second-cushion anterior portion to the second-cushion posterior portion, a second inward-facing surface, the second-cushion anterior portion including a second-cushion anterior releasable fastener located on the second inward-facing surface, wherein the second-cushion anterior releasable fastener releasably mates with the second anterior releasable fastener, the second-cushion posterior portion including a second-cushion posterior releasable fastener located on the second inward-facing surface, wherein the second-cushion posterior releasable fastener releasably mates with the second posterior releasable fastener;

an impact-plate assembly comprising a garment anchor, the impact-plate assembly including an anterior plate assembly, a posterior plate assembly, and a shoulder assembly, the shoulder assembly including an arched frame connecting the anterior plate assembly to the posterior plate assembly, the arched frame including a convex, crown-side surface, and a concave surface opposing the convex, crown-side surface, wherein the first-cushion shoulder yoke and the second-cushion shoulder yoke are configured to nest within the arched frame; and a textile securing garment at least partially covering the impact-plate assembly, the textile securing garment comprising a securing garment fastener configured to releasably secure to the garment anchor of the impact-plate assembly.

2. The garment of claim 1, wherein the first cushioning component comprises a first perimeter edge forming a first boundary around the first cushioning component, and the second cushioning component comprises a second perimeter edge forming a second boundary around the second cushioning component, the first perimeter edge of the first cushioning component of the first impact-attenuation component being discontinuous with the second perimeter edge of the second cushioning component of the second impact-attenuation component.

3. The garment of claim 2, wherein the first and second anterior releasable fasteners and the first and second posterior releasable fasteners each comprise a first part of a male-and-female releasable fastener, and wherein the first-cushion and second-cushion anterior releasable fasteners and the first-cushion and second-cushion posterior releasable fasteners each comprise a second part of the male-and-female releasable fastener.

4. The garment of claim 2, wherein the first and second anterior releasable fasteners and the first and second posterior releasable fasteners each comprise a first part of a slidable-track releasable fastener, and wherein the first-cushion and second-cushion anterior releasable fasteners and the first-cushion and second-cushion posterior releasable fasteners each comprise a second part of the slidable-track releasable fastener.

5. The garment of claim 2, wherein the first impact-attenuation component includes a first set of characteristics and the second impact-attenuation component includes a second set of characteristics, the first set of characteristics being different than the second set of characteristics.

6. The garment of claim 5, wherein the first set of characteristics includes a first cushion-component profile, a first cushion-component width, a first cushion-component thickness, and a first cushion-component length; wherein the second set of characteristics includes a second cushion-component profile, a second cushion-component width, a second cushion-component thickness, and a second cushion-component length; and wherein at least one of the first and second cushion-component profiles, the first and second cushion-component widths, the first and second cushion-component thicknesses, and the first and second cushion-component lengths are different, respectively.

7. The garment of claim 1, wherein the textile securing garment further comprises an anterior panel, a posterior panel, and a lateral panel, the lateral panel extending away from the anterior panel or the posterior panel, the lateral panel comprising a lateral panel releasable fastener, the lateral panel configured to releasably secure to the garment anchor using the lateral panel releasable fastener, and wherein a secured configuration of the lateral panel releasable fastener restrains the impact-plate assembly.

8. A shoulder-pad system comprising:

an impact-attenuation sub-layer that is positioned underneath an impact-plate assembly and a textile securing garment, the impact-attenuation sub-layer, the impact-plate assembly, and the textile securing garment making up at least part of the shoulder-pad system;

the impact-attenuation sub-layer comprising a cushioning component, the cushioning component comprising:

a first surface, a second surface, and a thickness between the first surface and the second surface, the first surface facing towards the impact-plate assembly, and an anterior cushion portion, a posterior cushion portion, and a shoulder yoke, the shoulder yoke connecting the anterior cushion portion to the posterior cushion portion;

the impact-plate assembly comprising a garment anchor, the impact-plate assembly including an anterior plate assembly, a posterior plate assembly, and a shoulder assembly, the shoulder assembly including an arched frame connecting the anterior plate assembly to the posterior plate assembly, the arched frame including a convex, crown-side surface, and a concave surface opposing the convex, crown-side surface, wherein the shoulder yoke of the cushioning component is nested within the arched frame, the first surface of the cushioning component being layered directly against the concave surface of the arched frame; and the textile securing garment having a unitary construction that at least partially covers the impact-plate assembly, the textile securing garment having a first shoulder portion and a second shoulder portion forming a neck opening, the textile securing garment comprising a securing garment fastener configured to releasably secure to the garment anchor of the impact-plate assembly.

9. The shoulder-pad system of claim 8, further comprising:

a shirt body comprising an anterior portion, a posterior portion, a first shirt shoulder yoke, and a second shirt shoulder yoke, the anterior portion, the posterior portion, the first shirt shoulder yoke, and the second shirt shoulder yoke being constructed of one or more textile layers, the first and second shirt shoulder yokes connecting the anterior portion to the posterior portion;

the shirt body comprising an outward-facing surface having one or more first releasable fasteners; and the second surface of the cushioning component of both the first lateral side and the second lateral side comprising one or more second releasable fasteners that releasably mate with the one or more first releasable fasteners.

10. The shoulder-pad system of claim 9, wherein the cushioning component of the first lateral side comprises a first perimeter edge forming a first boundary around the cushioning component and the cushioning component of the second lateral side comprises a second perimeter edge forming a second boundary around the cushioning component, the first perimeter edge of the cushioning component of the first lateral side being discontinuous with the second perimeter edge of the cushioning component of the second lateral side.

11. The shoulder-pad system of claim 8, further comprising an electronic controller coupled to the posterior plate assembly and a set of telemetry sensors integrated within the cushioning component of the first lateral side and the cushioning component of the second lateral side, the set of telemetry sensors configured to measure one or more biometric parameters and communicated the one or more biometric parameters to the electronic controller.

12. The shoulder-pad system of claim 8, further comprising epaulette plates coupled to the first and second lateral sides of the impact-plate assembly.

13. The shoulder-pad system of claim 8, wherein the textile securing garment further comprises an anterior panel, a posterior panel, and a lateral panel, the lateral panel extending away from the anterior panel or the posterior panel, the lateral panel comprising a lateral panel releasable fastener, the lateral panel configured to releasably secure to the garment anchor using the lateral panel releasable fastener, and wherein a secured configuration of the lateral panel releasable fastener restrains the impact-plate assembly.

* * * * *